US006682286B1

(12) United States Patent
Artrip

(10) Patent No.: US 6,682,286 B1
(45) **Date of Patent: *Jan. 27, 2004**

(54) SYSTEM AND METHOD FOR FORMING LIFT-TAB CAN END ASSEMBLIES

(75) Inventor: Donald Jason Artrip, Bluff City, TN (US)

(73) Assignee: Jerry Artrip, Bluff City, TN (US)

( * ) Notice: Subject to any disclaimer, the term of this patent is extended or adjusted under 35 U.S.C. 154(b) by 340 days.

This patent is subject to a terminal disclaimer.

(21) Appl. No.: 09/731,547

(22) Filed: Dec. 8, 2000

Related U.S. Application Data

(63) Continuation-in-part of application No. 09/221,397, filed on Dec. 28, 1998, now abandoned, which is a continuation of application No. 08/711,509, filed on Sep. 10, 1996, now Pat. No. 6,022,179, which is a continuation-in-part of application No. 08/014,268, filed on May 12, 1993, now Pat. No. 5,660,516.

(51) Int. Cl.[7] ..... B21D 51/44

(52) U.S. Cl. ..... 413/66; 413/25; 413/14; 413/16

(58) Field of Search ..... 413/12, 14, 16, 413/25, 66; 29/525.1, 525.2, 809, 818; 72/405.1, 424, 426, 405

(56) References Cited

U.S. PATENT DOCUMENTS 6,022,179 A * 2/2000 Artrip ..... 413/66

* cited by examiner

*Primary Examiner*—W. Donald Bray

(57) ABSTRACT

A system and process is disclosed for use in forming lift-tab can ends. A press is employed to form lift tabs in a strip of stock material. The strip of material with the lift tabs formed therein is passed through a conversion press where the tabs are removed from the strip and attached to a can end. The tab press which forms the lift tabs in the stock material is capable of receiving strips of stock material having varying widths. If the strip of the stock material is of such width that more than one lane of tabs is formed in the material, then tooling may be provided, either in the press or as a separate device, such that the strip of stock material having tabs formed therein may be separated in such a manner that a plurality of strips may be formed, each having a lane of lift tabs therein.

5 Claims, 20 Drawing Sheets

SYSTEM AND METHOD FOR FORMING LIFT-TAB CAN END ASSEMBLIES

CROSS-REFERENCE TO RELATED APPLICATIONS

This application is a continuation-in-part of the patent application Ser. No. 09/221,397, filed on Dec. 28, 1998, and entitled SYSTEM AND METHOD FOR FORMING LIFT-TAB CAN END ASSEMBLIES, now abandoned which is a continuation of application Ser. No. 08/711,509 filed Sep. 10, 1996, and entitled SYSTEM AND METHOD FOR FORMING LIFT-TAB CAN END ASSEMBLIES, now U.S. Pat. No. 6,022,179 and entitled SYSTEM AND METHOD WHEN FORMING LIFT-TAB CAN ASSEMBLIES, which is a continuation-in-part of application Ser. No. 08/014,268, filed May 12, 1993, now U.S. Pat. No. 5,660,516 and entitled TURNING EASY OPEN CAN TOPS OVER AUTOMATICALLY WHEN THESE TABS ARE MADE UPSIDE DOWN.

FIELD OF THE INVENTION

The present invention relates to containers for the food and beverage industry, and particularly to those beverage containers or cans which have lift-tab assemblies.

BACKGROUND AND SUMMARY OF THE INVENTION

In the production of lift-tab can ends, the lift-tab is formed rough-side-up or bottom-side-up and it has been necessary to invert the tabs so that they are positioned smooth-side-up, prior to the attachment to a can end. This inversion has generally been accomplished manually, and consequently, it is desirable to provide a method wherein the tab is inverted automatically, thereby saving labor. Alternatively, it is desirable to provide a method of production wherein the lift-tab is formed rough-side-down or top-side-up, thereby eliminating the need for inversion of the lift-tab altogether.

In my invention, I provide a first press machine which makes the can end and a second press machine, or tab press, which makes the can end lift-tab. A third press machine, or conversion press, is provided which attaches the lift-tab to the can end to form lift-tab can ends. All three of the press machines are separate machines. Can ends are generally advanced from the first press to the third press by means of a conveyor.

Unlike many of the devices of the prior art, my invention does not provide a tab punch disposed at the exit of the tab press to remove the tab from the strip of material from which it is made, but rather accomplishes this task later in the lift-tab attachment process. By deferring the punching of the lift-tabs from the strip at the tab press exit, the strip as a whole may be inverted rather than necessitating the inversion of each individual lift-tab. To accomplish the inversion of the metal strip, a drive roller is provided on the frame of the tab press that rolls the strip of metal stock material, with the formed lift-tabs loosely attached, across a series of rollers or through a guide which inverts the metal strip via either a half twist or a half loop rotation in the guide or on the rollers.

Alternatively, a tab press including a die which presses tabs rough-side-down or top-side-up may be utilized. When such a tab press is utilized, it is no longer necessary to invert the lift-tabs by way of a half loop or half twist prior to their introduction into a conversion press.

With the lift-tabs now properly situated relative to the can ends through either (1) inversion of the tab by half loop or a half twist, or (2) use of a tab press, including a die which presses tabs rough-side-down or top-side-up, the invention provides two alternative methods of placing the lift-tabs into the proper position for attachment to the can ends.

In addition, the invention describes alternative methods of routing the lift-tabs through the process. The first method involves the running of the strip of metal stock material with the formed lift-tabs loosely attached through a locating means so that the strip will go into the conversion press with the lift-tabs being properly positioned with respect to a can end such that the conversion press may, in the same motion, detach the tab from the strip and attach the tab to the can end to form a lift-tab can end.

The second method of getting the tabs into working relationship with the can ends is to pass a strip of metal stock material with lift-tabs formed therein through a tab punching station where a tab punch knocks the formed tabs from the strip of metal stock material into a number of lanes with the smooth side of the tabs facing up. The lift-tabs then slide or are conveyed from the punching station to a conversion press. As the production of the lift-tabs is commonly quicker than the attachment of the lift-tabs to the can ends, and the lift-tabs will accumulate in their lanes adjacent to the conversion press.

The conversion press has attached thereto a tab ejector which feeds one lift-tab from the lane of tabs into the conversion press and properly positions the tab with respect to the can end so that as the conversion press takes a downstroke, the lift-tab is attached to the can end.

This invention provides for the use of any number of commercially available conversion presses. Additionally, the tab press is capable of operating such that a plurality of lift-tabs are created along a width of the strip of metal stock material. Furthermore, it is possible for the tab press to be operated with several lift-tab forming heads operating on a plurality of strips of metal stock material running alongside of one another in the tab press.

In the case where a single strip of metal stock material is pressed so that there are multiple tabs formed across its width, to avoid having to punch the tabs out of the strip prior to entering a conversion press or having to route the strip to a number of different conversion presses, the user can insert a commercially available plasma cutter or another conventional cutter which will precisely cut the wide strip of formed lift-tabs into individual strips of lift-tabs enabling the individual strips to be conveyed to and pass through a conversion press in the manner described above.

Another version of the second method of producing separate strips with one lane of formed lift-tabs in each strip is to provide a tab press with tooling which separates the single strip of metal stock material into individual strips and forms lift-tabs in each individual strip.

An alternative scheme involving the routing of separate tab-formed strips to their designated conversion presses is to pass a plurality of individual strips of stock material through the tab press in such a manner that the tab press produces separate strips with one lane of formed lift-tabs in each strip. This method of operation provides that if one or more of the conversion presses becomes inoperative, then the tab strip intended for use with that conversion press can be taken out of the inoperative press or presses and all other presses can continue to run. Separate paths through the press as well as separate guide means which route the strips along the separate paths would be necessary when utilizing the separate and individual tab formed strips. Each strip of stock material can be propelled through the tab press by a commercially available feeder such as a Ferguson Camtrol roll feed. A second roll or drive feed can be inserted to advance the tab formed strips on to the designated conversion presses.

Presses for converting ends for cans and the like are known. Presses of this type are available from the Minister Machine Company of Minister, Ohio. U.S. Pat. No. 4,568,230 shows a layout of a press for processing workpieces into finished can ends with an opening tab attached thereto.

Presses used for the manufacture of easy-open can ends generally comprise a press bed mounted on legs which rest on the floor. Four columns or uprights are mounted on the press bed. The columns or uprights support a crown in which a main drive for the press components is mounted. The columns have slides attached therein for supporting a reciprocating main ram. The main ram carries the upper tooling of the main die set, which cooperates with lower tooling on the bed. The main die set defines a plurality of stations in which the can ends are progressively converted into easy-open can ends. A conveyor carries the can ends into and through the stations of the die set. The tabs are formed by tab tooling, which is supplied with strip stock by a stock feed device. The tab tooling forms a tab and separates it from the strip stock for attachment to a can end.

The tab tooling has conventionally been mounted on the press bed laterally of the conveyor and laterally of the main die. The tab tooling may also be split so that it is arranged laterally on both sides of the main die. A bridge is required to transfer the tab stock strip across the main die set. Such an arrangement is shown in U.S. Pat. No. 4,568,230. The upper tooling is mounted on the main ram of the press.

One of the deficiencies associated with this arrangement of the tooling is that it is difficult to access the tooling for maintenance. Access to the can end tooling is difficult due to the presence of the tab tooling on one side of the main die and the tab tooling and tab stock feed device on the other side of the main die. The lateral placement of the tab tooling also increases the depth of the press from front to back. This requires a larger bed which increases the weight of the press and reduces its speed.

The present invention overcomes the disadvantages of the laterally-placed, split tab tooling by locating the tab tooling in another press where the only tooling is the tooling associated with the tab press. Placing the tab die set in another press allows full access to the main die from either the front or back of the press. Neither the tab tooling or its stock feed device obstruct access to the main die set. This placement of the tab tooling also permits a reduction in the width of the press between the columns and thus a reduction in weight of the press which allows the press to run at a higher speed. Another benefit of the tab tooling placement of the present invention is that it allows servicing of the tab die within the press. Still another benefit of placing the tab tooling and the can end tooling in separate presses is that there can be an additional tab press ready for substitution into the production line at any time a tab press in operation breaks down or needs to be shut down for repairs. The advantage of the present invention is increased productivity through higher operating speed and reduced down time for maintenance and tab press stock-up.

This invention resides in a process and system for use when forming lift-tab can end assemblies, wherein each lift-tab can end assembly includes a lift-tab having a smooth side, an opposite roughened side, a hole extending between the sides of the lift-tab, and a rivet or shaft, extending from the can end, adapted to receive the hole in the lift-tab, during an assembly-forming process.

One embodiment of the process includes a step of conveying a strip of metal stock material containing lift-tab forms from the tab press to a conversion press, during which conveyance the metal strip is inverted by passage along or through a half-loop of about 180 vertical degrees, or a half-twist of about 180 degrees, so that the strip of metal stock material is inverted from the orientation it had when it emerged from the tab press. The inverted strip of metal stock material is then conveyed into the conversion press, where each tab is separated from the strip of metal stock and attached to the can end in the same motion of the conversion press.

The length of the run between the tab press and the conversion press will determine whether any guide means are required to support the strip of metal stock.

The system of the invention includes means for advancing formed can ends through a first workstation so that as the can ends are advanced therethrough, the shafts or rivets formed therein protrude generally upward. Means are also included for conveying a strip of metal stock through a tab press wherein a first press means is provided for stamping lift-tab forms into the strip of metal stock so that the lift-tabs are loosely attached to the remainder of the strip and are oriented smooth-side-down as they exit the tab press. The conveying means is adapted to direct the strip stock which has been stamped with the lift-tab forms along a path through which the strip stock is inverted, so that as each lift-tab moves into the conversion press, the lift-tab is positioned smooth-side-up.

In an alternative embodiment, the step of inverting the lift-tabs by about 180° is eliminated through the use of a tab press having a die arranged such that the lift-tabs are punched rough-side-down or top-side-up.

The system also includes means for directing the lift-tab formed strip to a position such that a lift-tab is disposed above a can end positioned in the conversion press. The directing means is coordinated with the can end conveying means so that as each can end is advanced into the attachment position at the conversion press, a lift-tab within the strip of metal is moved above the can end so that the hole in the lift-tab is positioned directly above the upwardly-directed shaft formed in the can end.

DETAILED DESCRIPTION OF THE PREFERRED EMBODIMENTS OF THE INVENTION

Figure 9:
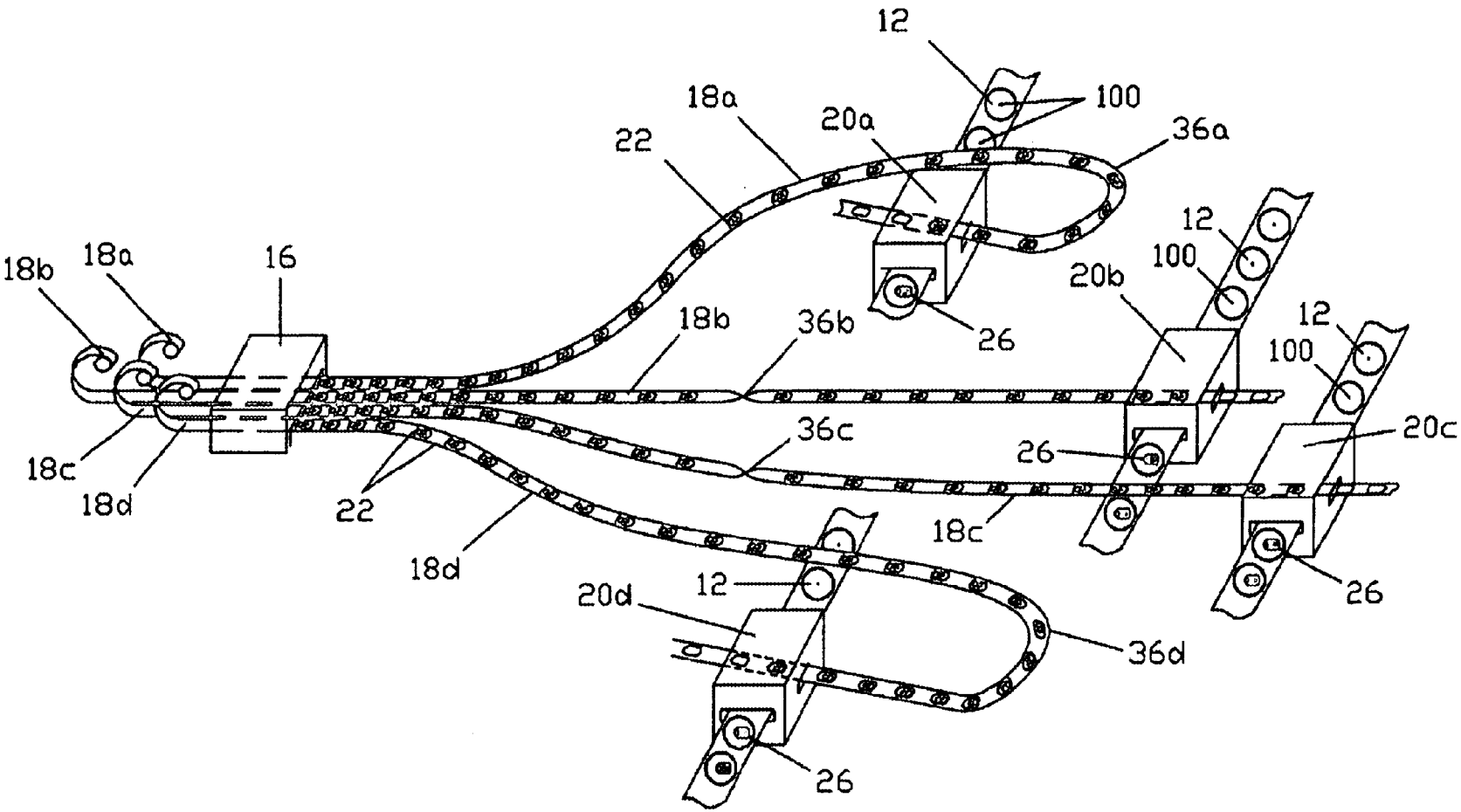
FIG. 9 is a view of multiple tab formed strips going through designated conversion presses where tabs are detached from the strips and attached to can ends to form lift-tab can ends.

Three general embodiments of the present invention are envisioned. Referring now to FIG. 9, a first press or machine (not shown) creates a plurality of can ends 12. Next, the can ends 12 are positioned in a can end guide 14 such that the top end of each of the can ends 12 is protruding out of the can end guide 14. Each of these can ends 12 has a rivet 100 protruding outwardly therefrom. A second press, a tab press 16, is operating separately from the first press, and is forming lift-tabs in a plurality of strips 18*a*, 18*b*, 18*c* and 18*d* of metal stock material being passed through it.

As the can ends 12 on the can end guide 14 approach a third press, the conversion press 20, the can ends will be congested. The portion of guide 14 which passes through the conversion press 20 will constrict the path along which the can ends can move laterally. As the can ends enter the conversion press 20, conveyor means (not shown) will advance the can ends 12 under a bridge (not shown) which is supporting the metal strip 18*a* having lift-tabs 22 formed therein. Metal strip 18*a* is also positioned between guides (not shown) which limit sideways motion of the metal strip 18*a* as it passes through the conversion press 20. Conversion press 20 advances can ends 12 and strip 18*a* at predetermined increments such that rivet 100 protruding from can end 12 is positioned directly below the rivet hole (not shown) in lift-tab 22. Once the can end 12 and lift-tab 22 are properly positioned, the conversion press 20, in the same step or downstroke, detaches lift-tab 22 from metal strip 18*a* and secures tab 22 to the can end 12 to form a lift-tab can end 26.

The conversion press 20 operates in a reciprocal up and down motion. On each downstroke a lift-tab 22 is secured to a can end 12, and with each upstroke of conversion press 20, the can ends in guide 14 and the metal strip 18 in guides 76, 78 (see FIG. 12) are advanced at predetermined rates to secure a tab to each can end. Then the can end, which has just had a lift-tab attached thereto, is removed from the press 20 and the next can end 12 and lift-tab 22 are aligned for attachment of the lift tab to the can end.

Figure 1:
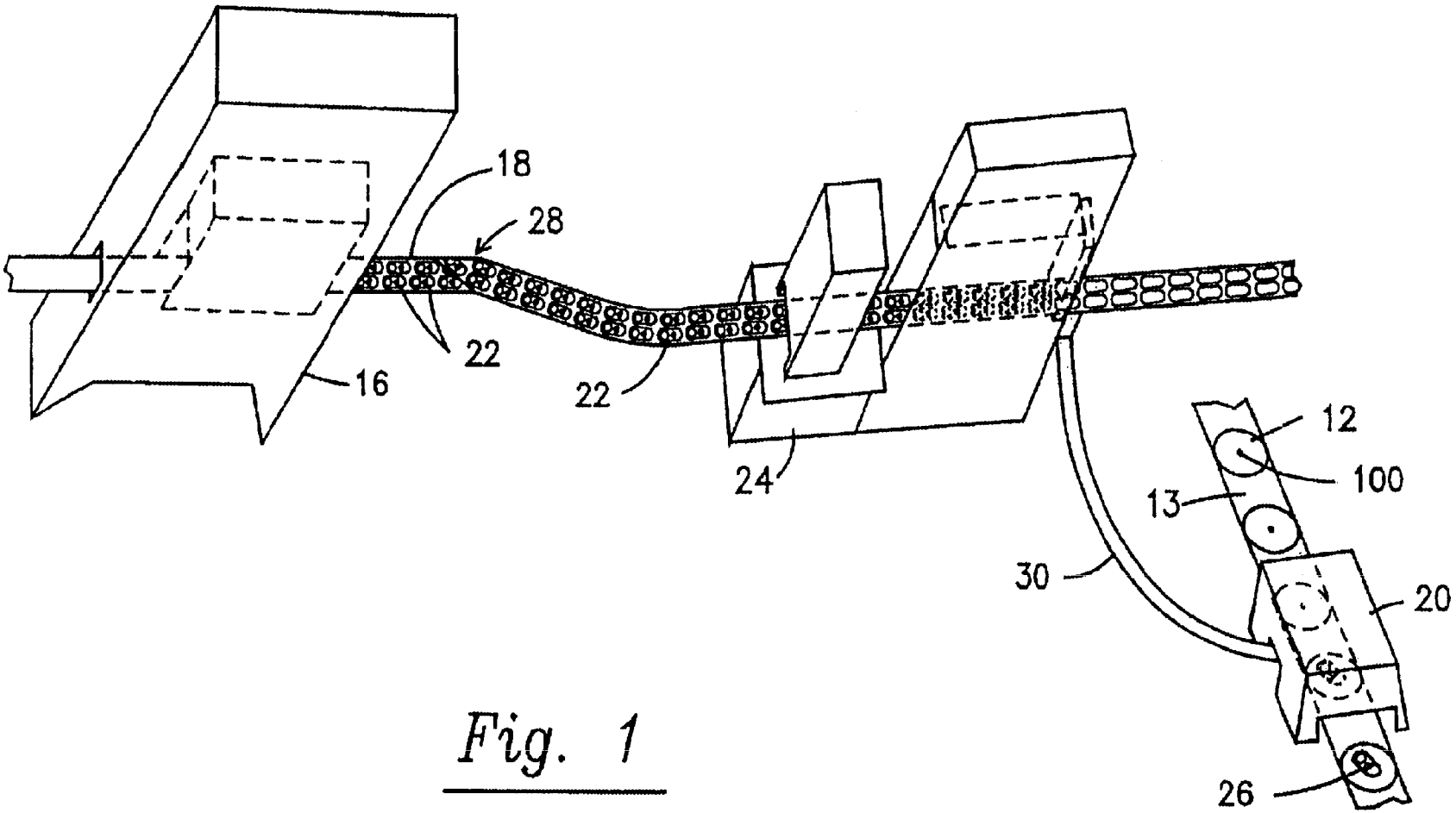
FIG. 1 is a view showing a tab formed strip emerging from a tab press, passing through a half-twist, further passing into a tab punching station where a lane of tabs is punched from the tab strip and the tabs are thereafter conveyed to a conversion press and attached to can ends.

FIG. 1 illustrates a schematic representation of a preferred embodiment of a system of the invention including a tab press 16, a tab punching station 24 and a conversion press 20. A strip 18 of metal stock is passed through the tab press 16 where lift-tabs 22 are formed therein, and then the strip 18 is passed through a half twist 28 before reaching the tab punching station 24. It follows that as the strip 18 passes through the half twist 28, the tabs 22 formed in the strip 18 are inverted. The means for passing the strip through half twist 28 can be comprised of a guide or series of rollers or any other suitable means (not shown in FIG. 1), positioned such that strip 18 is inverted before entering the punching station 24. At the tab punching station 24, the tabs 22 are punched from the strip 18 and into lane or chute 30 which conveys the tabs 22 to the conversion press 20 where the tabs 22 are attached to the can ends 12.

Figure 2:
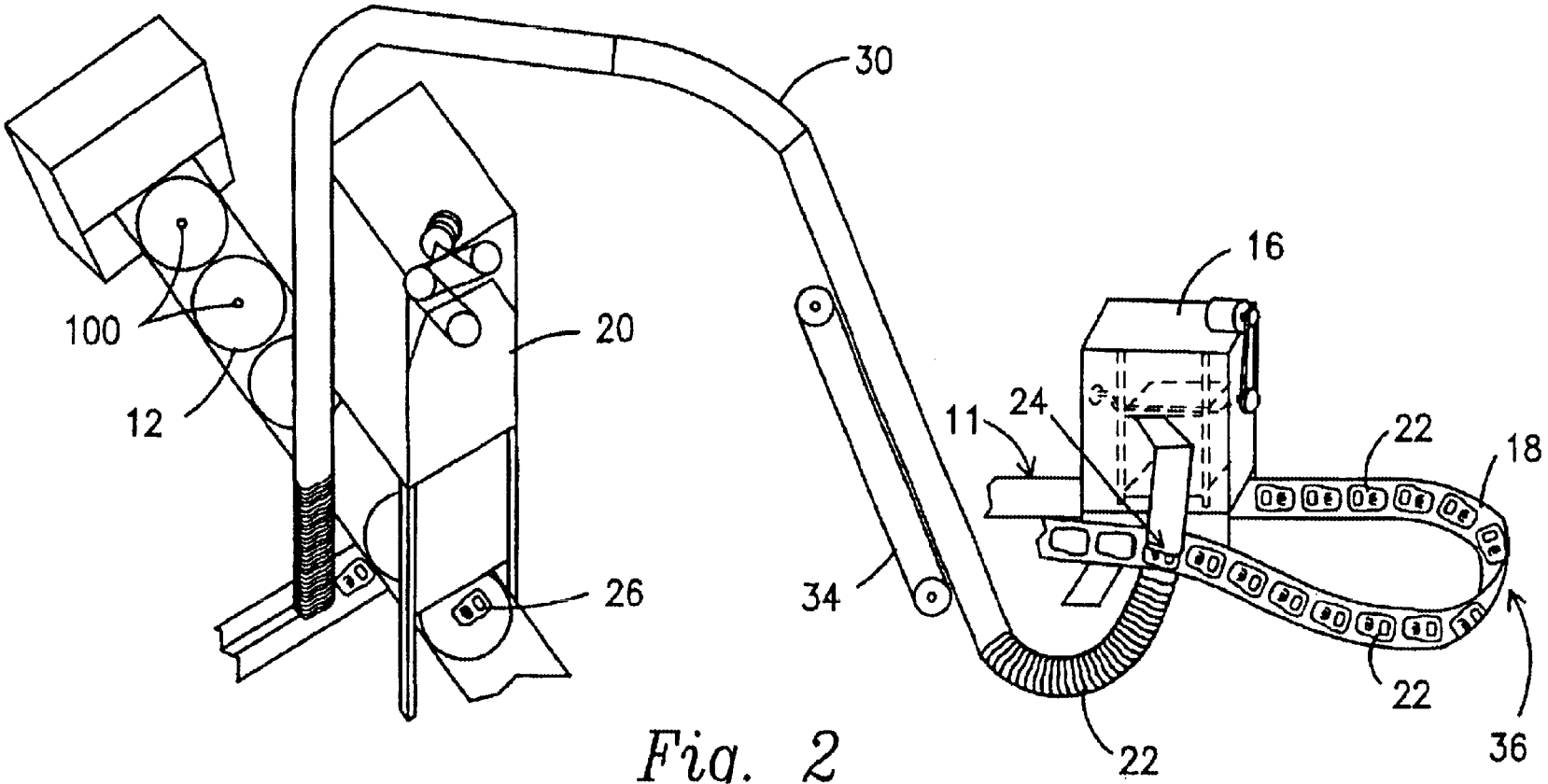
FIG. 2 is a view showing a tab formed strip emerging from a tab press, passing through a half-loop, further passing into a tab punching station where a lane of tabs is punched from the tab strip and the tabs are thereafter conveyed to a conversion press and attached to can ends.

FIG. 2 illustrates a more detailed view of a portion of a preferred embodiment of the invention, including a tab press 16, a lane or chute 30, having a conveyor 34 and a conversion press 20. Lift-tabs 22 are punched from a strip 18 at the tab press 16 and conveyed to the conversion press 20 by way of chute 30. As can be seen in FIG. 2, the strip 18 of metal stock with the tabs 22 loosely attached are routed through a half loop 36 before the tabs 22 reach punching station 24. Conveyor 34 moves tabs 22 through chute or lane 30 and positions them smooth side up for entry into conversion press 20.

Figure 3:
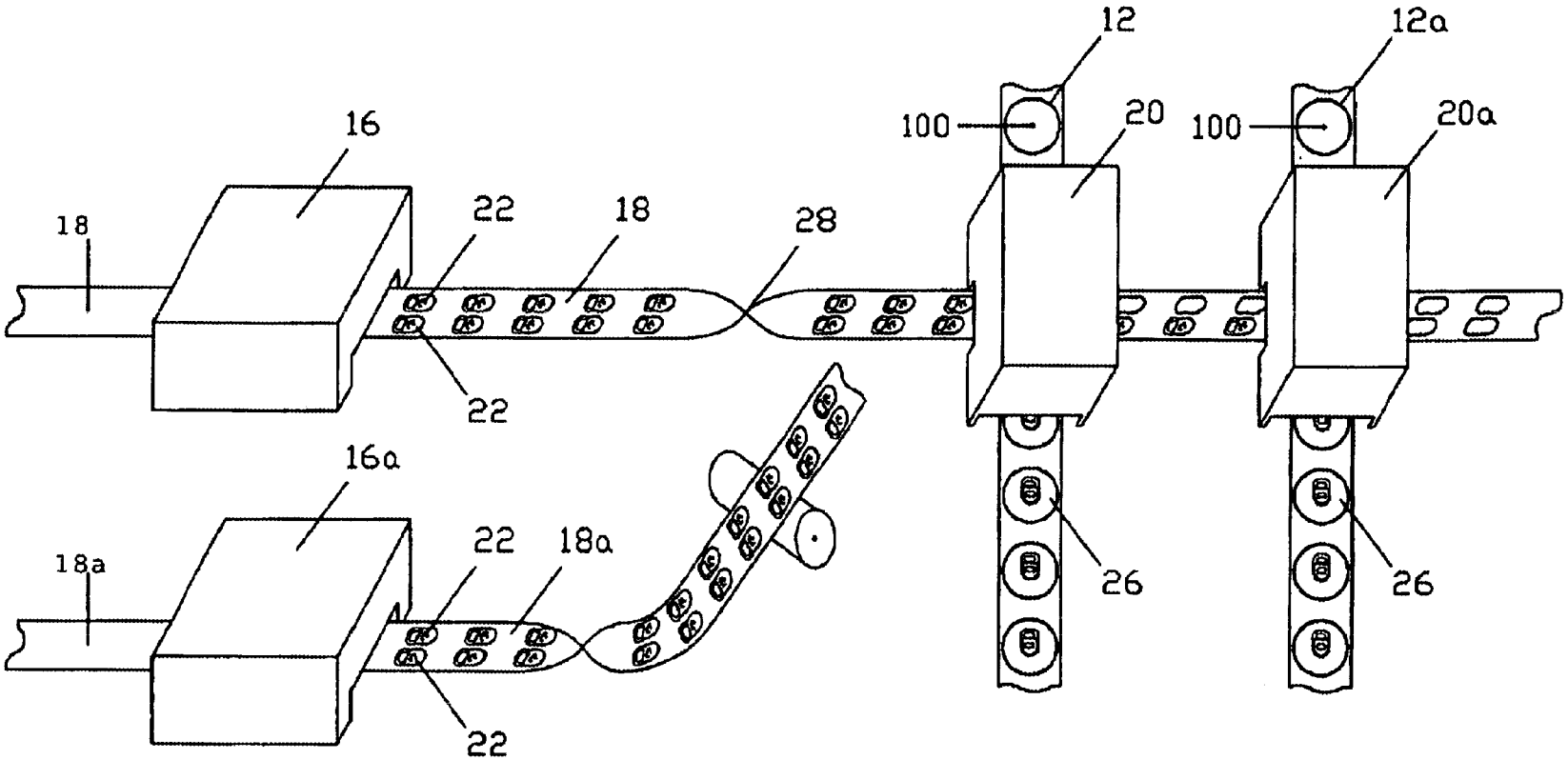
FIG. 3 is a view showing a tab formed strip emerging from a tab press, passing through a half-twist, and further passing through two conversion presses where a lane of tabs is detached from the tab strip and attached to a row of can ends in the first conversion press and the other lane of tabs is used in the second conversion press in the same way. An additional tab press in a stand-by mode is also shown in the drawing.

FIG. 3 is an illustration of a process involving two tab-forming presses 16 and 16*a* and a pair of conversion presses 20 and 20*a*. In this embodiment of the invention, trips 18 and 18*a* of metal stock material, each having a width of at least the width of two lift-tabs, is passed through tab presses 16 and 16*a* where two rows of lift-tabs 22 are formed, and upon exiting tab presses 16 and 16*a* and before entering conversion presses 20 and 20*a* the lift-tab strips are inverted by means of a half-twist, as described above. The first conversion press 20 attaches the tabs 22 of one row in strip 18 to a series of can ends 12 routed through the first conversion press 20 while the second conversion press 20*a* attaches the lift-tabs 22 of the other row of the strip 18 to another series of can ends 12*a* routed through the second conversion press 20*a*

Unlike other machines available, the current invention is made, up of separate presses, i.e. the can end press (not shown), the tab press 16, and the conversion press 20. The use of separate machines or presses enables a variety of operations to be done without requiring them to be performed simultaneously. One of the biggest advantages is that because the various presses are separate in the present invention, when one breaks down or needs to be shut down for another reason, another press of the same type may be quickly substituted and the process of applying lift-tab can assemblies can continue. In FIG. 3 the second tab press 16*a* is an example of this as, in this illustration, it is an auxiliary tab press which remains in a standby mode until the first tab press 16 is shut down.

Figure 4:
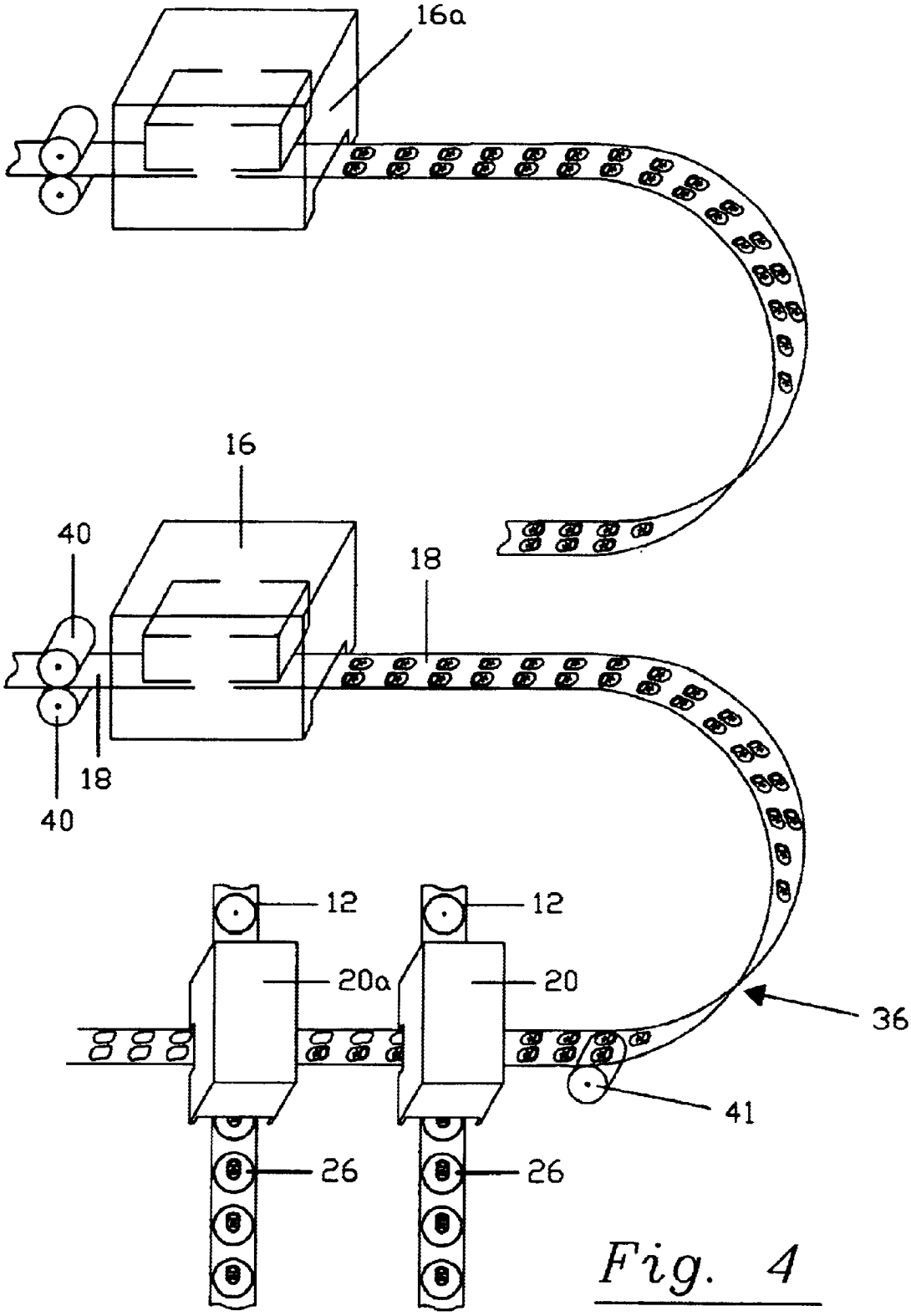
FIG. 4 is a view showing a tab formed strip emerging from a tab press, passing through a half-loop, and further passing through two conversion presses where a lane of tabs is detached from the tab strip and attached to a row of can ends in the first conversion press and the other lane of tabs is used in the second conversion press in the same way. An additional tab press in a stand-by mode is also shown in the drawing.

FIG. 4 illustrates the same process seen and described in FIG. 3 with the substitution of a half loop 36 for the half twist 28 of FIG. 3 as the strip inversion means. Once again, a second tab press 16*a* is shown in the background as ready to move into production when the first tab press 16 is shut down or shut off. FIG. 4 also illustrates the drive means, in this case a series of drive rollers 40, used to advance strip 18 into tab press 16, around the half loop 36, and into the conversion presses 20 and 20*a*.

Figure 5:
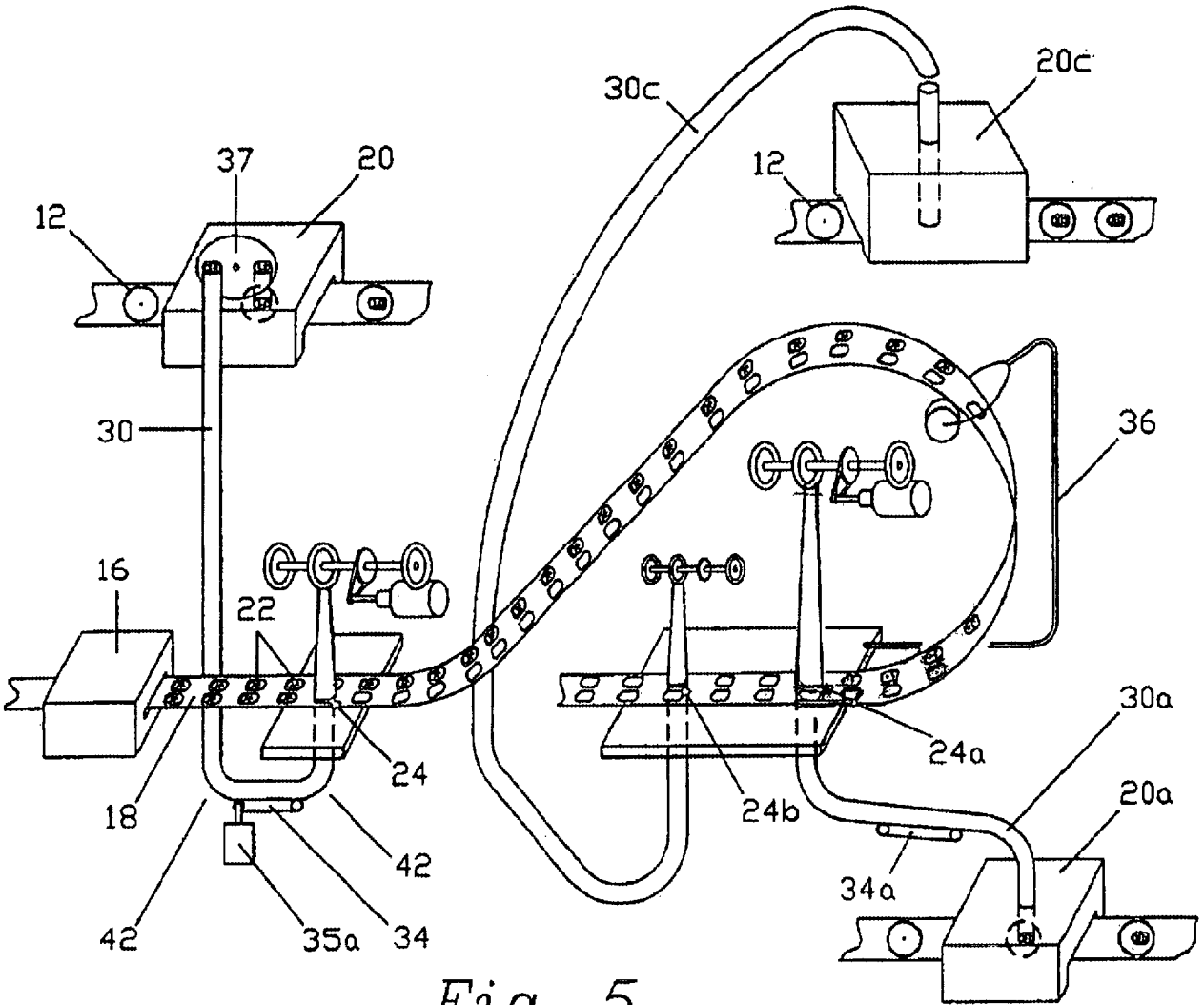
FIG. 5 is a view showing a strip of tabs exiting a tab press. One lane of tabs is punched from the un-inverted part of the strip into a tab conveyor routed through a 180 degree vertical bend enroute to a conversion press. The tab strip further passes through a half-loop, where the strip of remaining tabs is inverted, and thereafter another lane of tabs is punched into a tab conveyor traversing two 180 degree vertical bends enroute to a conversion press.

FIG. 5 shows an alternative embodiment of the invention. In this embodiment, tab press 16 is shown to form a strip of lift-tabs 22 at least two tabs wide. The tabs 22 are punched by tab punch 24 from a strip 18 of formed tabs into a lane or chute 30 where the tabs 22 are inverted by means of a half loop 42 and stacked smooth side up next to conversion press 20. In the alternative, lane or chute 30 could be provided with a half twist (not shown) to invert the tabs prior to their arrival at the conversion press. A conveying means 34 of the type well known in the art, conveys lift-tabs 22 to the attachment point, not shown, within the conversion press 20 where they are attached to the can ends.

The FIG. 5 system also illustrates a second tab punch 24*a* and conversion press 20*a*. Prior to passing through tab punch 24*a*, strip 18 is inverted by half-loop 36. Consequently, lane 30*a* does not invert tabs 22 as they are in proper orientation for use in the second conversion press 20*a*

Figure 6:
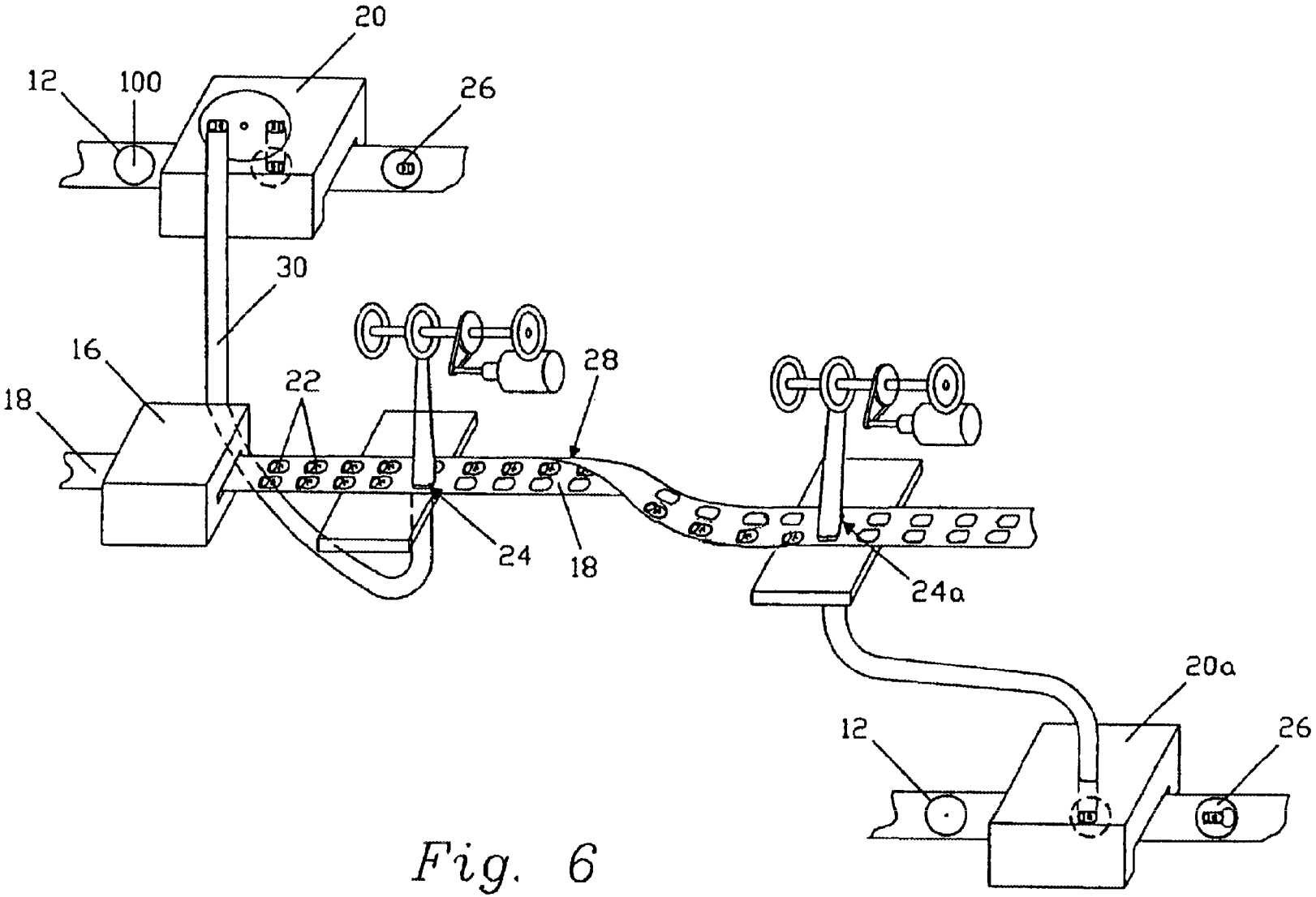
FIG. 6 is a view of a tab formed strip exiting a tab press. Tabs are punched into a lane and conveyed through a 180 degree vertical bend and to a conversion press. The tab strip is advanced further before being inverted through a half-twist and thereafter the remaining tabs are punched into a lane of tabs which is conveyed without inversion to a conversion press.

FIG. 6 shows another embodiment of the invention and shows one of the number of alternative setups possible with the inverters. Tab press 16 produces a tab formed strip 18. Prior to inversion of strip 18, tab punch 24 punches one side of tabs 22 in strip 18 into chute or lane 30. The lift-tabs 22 in chute 30 are inverted enroute to a first conversion press 20. Strip 18 incurs a half twist 28 and is inverted relative to its position emerging from tab press 16. Tabs 22 from inverted strip 18 are punched out by tab punch 24*a*, and enter conversion press 20*a* where lift-tabs 22 are attached to can ends 12 in the same downward motion of the conversion press to form lift-tab can ends 26.

Figure 7:
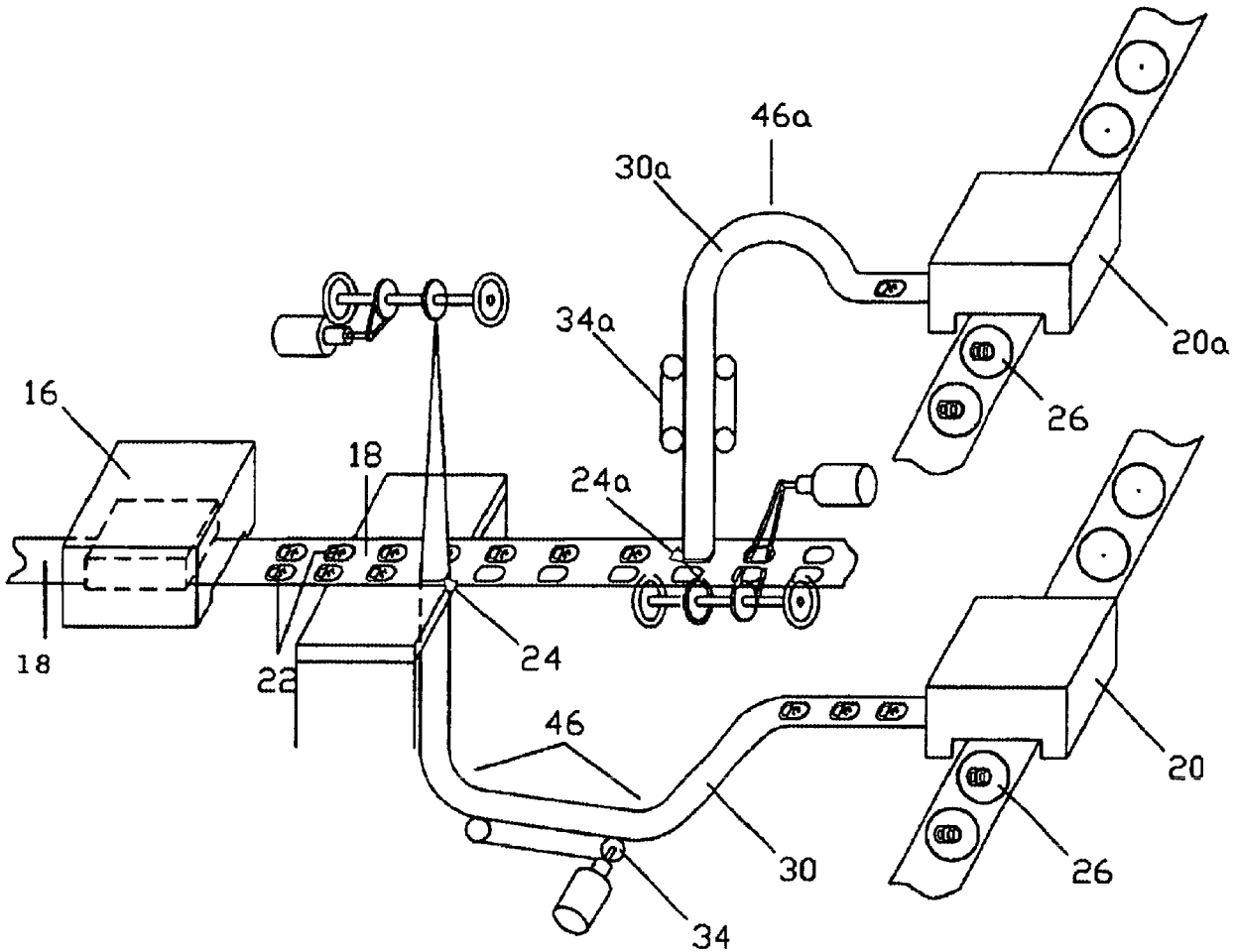
FIG. 7 is a schematic representation of a system wherein tabs are punched from a tab formed strip and inverted 180 degrees before being passed to a station at which the tabs are attached to can ends to form lift-tab can ends.

FIG. 7 is an illustration of another embodiment of the invention including a tab press 16 and a strip 18 of metal stock material from which tabs 22 are punched by tab punches 24, 24*a* and inverted as they are routed toward conversion presses 20, 20*a* In particular, each conveyor 34, 34*a* conveys tabs 22 passing through chutes 30, 30*a* through a 180 degree vertical bend 46, 46*a* which inverts the tabs 22. The tabs 22 are each removed from its corresponding chute 30, 30*a* upon arriving at a conversion press 20, 20*a* by a tab ejector (not shown) which aligns the tab over a can end in the end conversion press.

Figure 8:
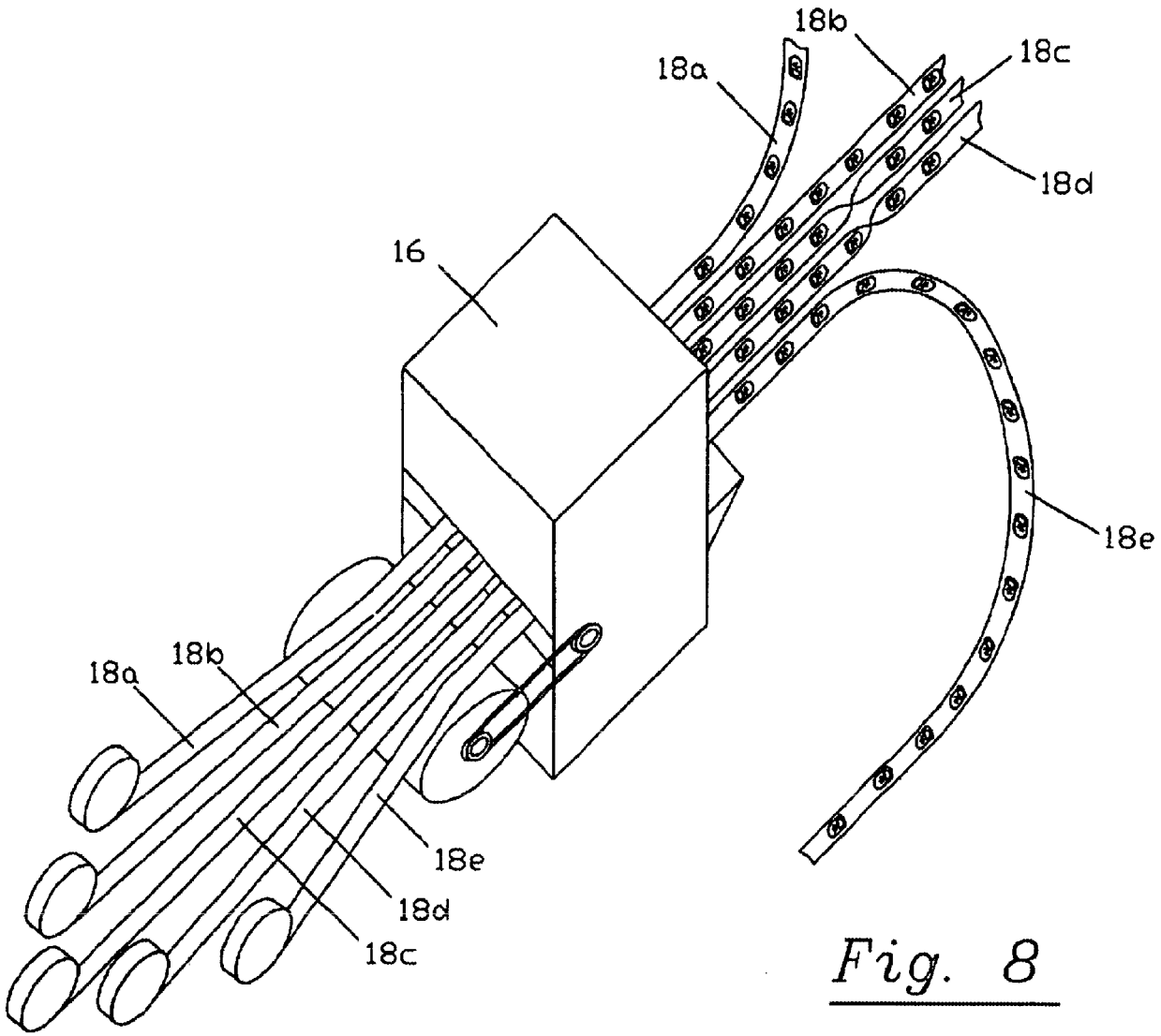
FIG. 8 is a view showing multiple strips of metal stock material going through a tab press forming multiple tab formed strips.

FIG. 8 illustrates an embodiment of tab press 16 which unlike the prior art is capable of using a plurality of strips 18*a*, 18*b*, 18*c*, 18*d* and 18*e* of metal stock so as to enable the strips 18*a*, 18*b*, 18*c*, 18*d* and 18*e* to be directed to numerous conversion presses (not shown) after passing through tab press 16. This embodiment allows the operator to adjust the number of strips of lift-tabs formed with great ease.

FIG. 9 illustrates an embodiment of the tab press similar to that of FIG. 8 with strips 18*a*, 18*b*, 18*c* and 18*d* of metal stock material being routed into a tab press 16 and thereafter passing with formed tabs 22 therein through the half-loops 36*a*, 36*d* or half-twists 36*b*, 36*c* before being directed into corresponding presses 20*a*, 20*b*, 20*c* and 20*d* for attachment to can ends 12.

Figure 10:
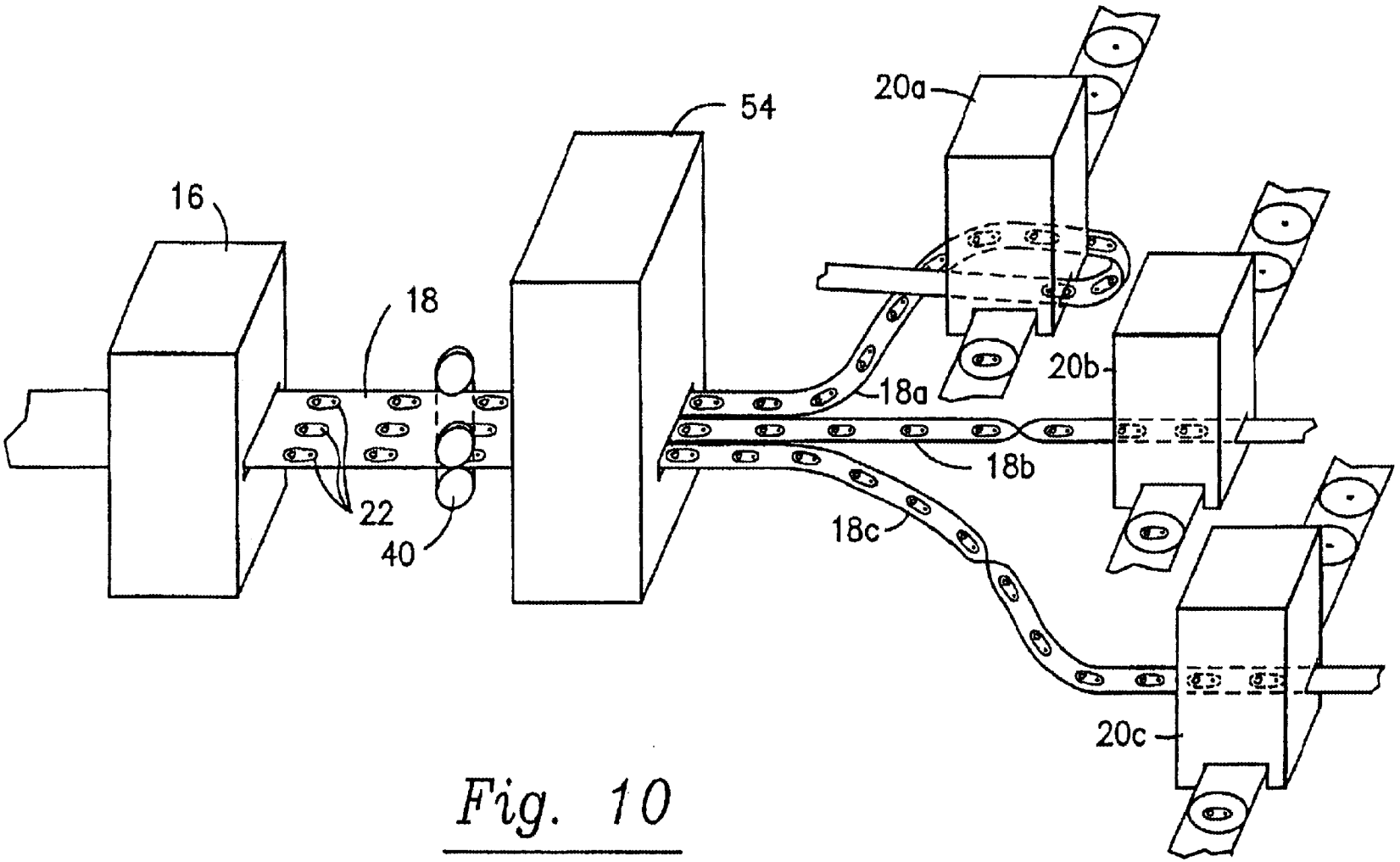
FIG. 10 is a view showing a multiple lane tab formed strip moving through a cutter which divides the strip into multiple strips containing one lane of tabs each. Each strip of tabs is propelled through a designated conversion press where each tab is detached from the strip and attached to a can end.

The embodiment of the invention illustrated in FIG. 10 is an alternative to those shown in FIGS. 8 and 9 and includes a plasma cutter 54 which is able to divide strip 18 having a multiplicity of tabs per width section into a multiplicity of strips 11*a*, 18*b*, 18*c* each containing one lane of tabs 22. The individual strips 18*a*, 18*b*, 18*c* of tabs 22 are then able to continue through the inversion process and conversion presses shown and described above. The width of the strips and correspondingly the number of lift-tabs per width of strip is also adjustable.

Figure 11:
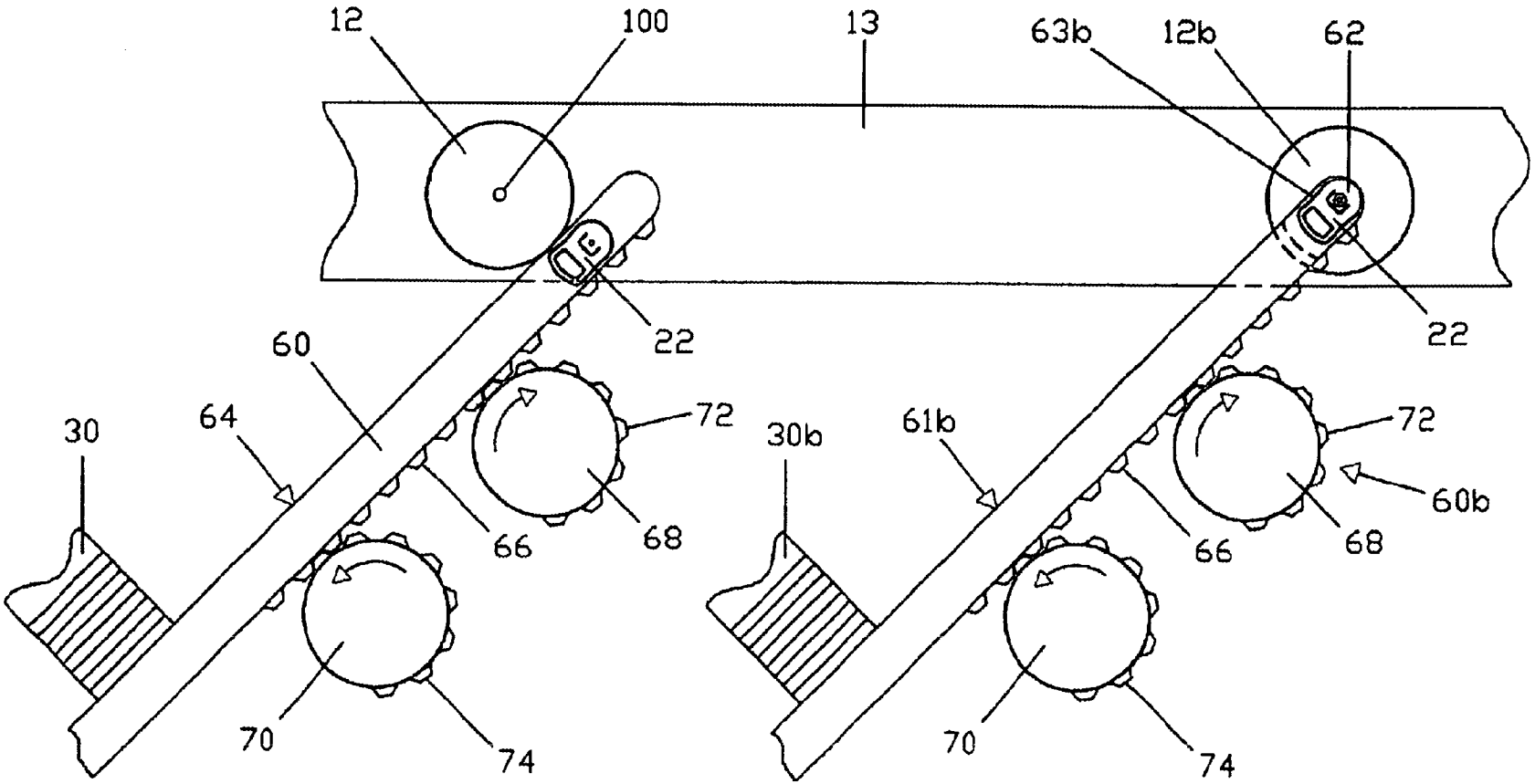
FIG. 11 is a schematic representation of a preferred tab ejector.

FIG. 11 is a schematic representation of one embodiment of a tab ejector system 60 utilized in one embodiment of a conversion press. In those embodiments where the lift-tabs 22 are punched out of the strip (not shown) and then conveyed in a lane or chute 30 next to the conversion press (not shown), it is necessary to use a tab ejector 60 to properly position or align the lift-tabs in the conversion press (not shown). The purpose of the tab ejector 60 is to select the bottom-most tab in chute 30 and properly position it with respect to a can end 12, so that upon the next downstroke of the conversion press (not shown), the lift-tab 22 will be correctly attached to the can end 12.

In order for the tab ejector to properly position the lift-tab 22 with respect to a can end 12, a locating or positioning means is used and may operate as follows: As the lift-tabs 22 are punched or removed from metal strip (not shown) they will be collected in at least one chute 30. The bottom of chute 30 is positioned adjacent to the conversion press. As the exposed can ends 12 are advanced through the conversion press, tab ejector 60 slides the lift-tab 22 which is at the bottom of chute 30 to a predetermined position relative to the conversion press. This predetermined position of lift-tab 22 allows for proper positioning of rivet hole 62 of lift-tab 22 and rivet 100 of can end 12. The conversion press then downstrokes to rivet lift-tab 22 to can end rivet 100. As the press upstrokes, the next can end 12 is advanced into the bed of the conversion press and ejector tab 60 positions the next lift-tab 22 over the upwardly-protruding rivet 100 formed in the can end 12.

The preferred embodiment of a tab ejector 60 consists of a tab seat (not shown) and a slide 64 which are positioned just slightly higher than the can end 12 in the conversion press 20. The tab ejector 60 slides the lift-tab 22 along slide 64 into a predetermined position at which point the lift-tab seat (not shown) is pulled from under the lift-tab 22 which allows the lift-tab rivet hole 62 to drop onto the upwardly protruding can end rivet 100. The movement of the underside slide of the tab ejector is preferably accomplished by the use of gear receiver track 66 and two gear wheels 68, 70 each being devoid of teeth along one half of its outer circumference. Gear wheels 68 and 70 turn in opposite directions so that as the slide 64 moves toward the predetermined position, the slide 64 stops because the teeth 72 in gear 68 run out of the track 66 and the teeth 74 on gear 70 come into contact with track 66, thereby moving the slide 64 in the opposite direction and returning the slide to the stack of tabs. The inward and outward sliding of slide 64 is repeated once for each downstroke of the conversion press.

Figure 12:
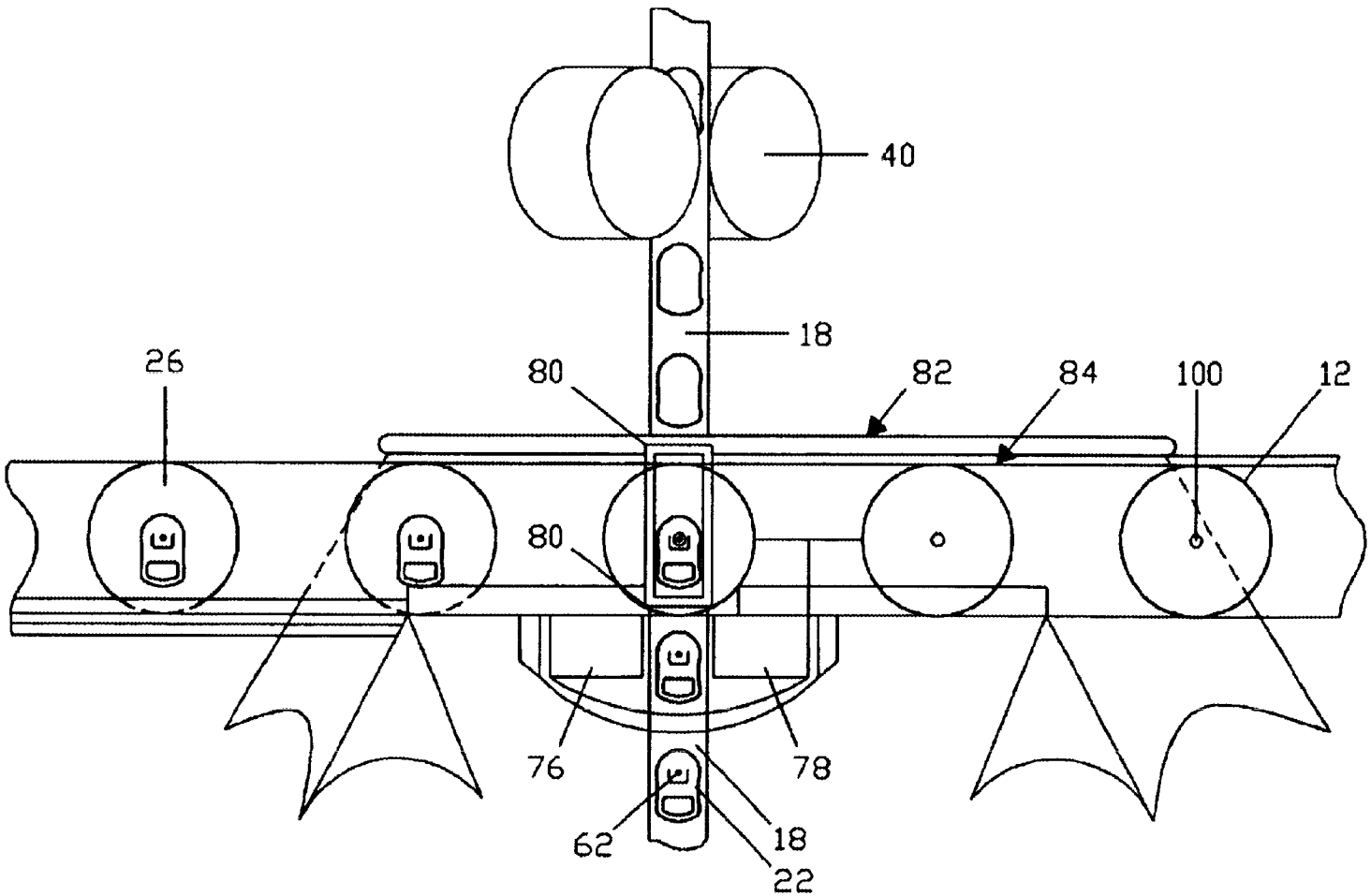
FIG. 12 is a view showing a preferred guide means for guiding the tab formed strip into the conversion press and also a bridge which guides the tab strip over the bed of the conversion press.

FIG. 12 shows guide means 76 and 78 guiding strip 18 into conversion press 20. Guide means 76, 78 function to position or locate metal strip 18 in the proper position entering the conversion press 20 and are just wide enough to allow strip 18 to pass through, which insures strip 18 will be in the proper position when the conversion press makes a downstroke. Also shown in FIG. 12 is a set of guides 80 or elevating bridges which raises strip 18 just high enough to pass over rivets 100 and into proper alignment and not catch on the rivets 100. Also shown is bridge 82 with guides 84 which guide can ends 12 into proper positioning in conversion press 20 where the tabs are attached to the can ends. Strip 18, devoid of tabs, is shown being advanced away from the conversion press 20 by means of drive roller or conveying roller 40.

Figure 13:
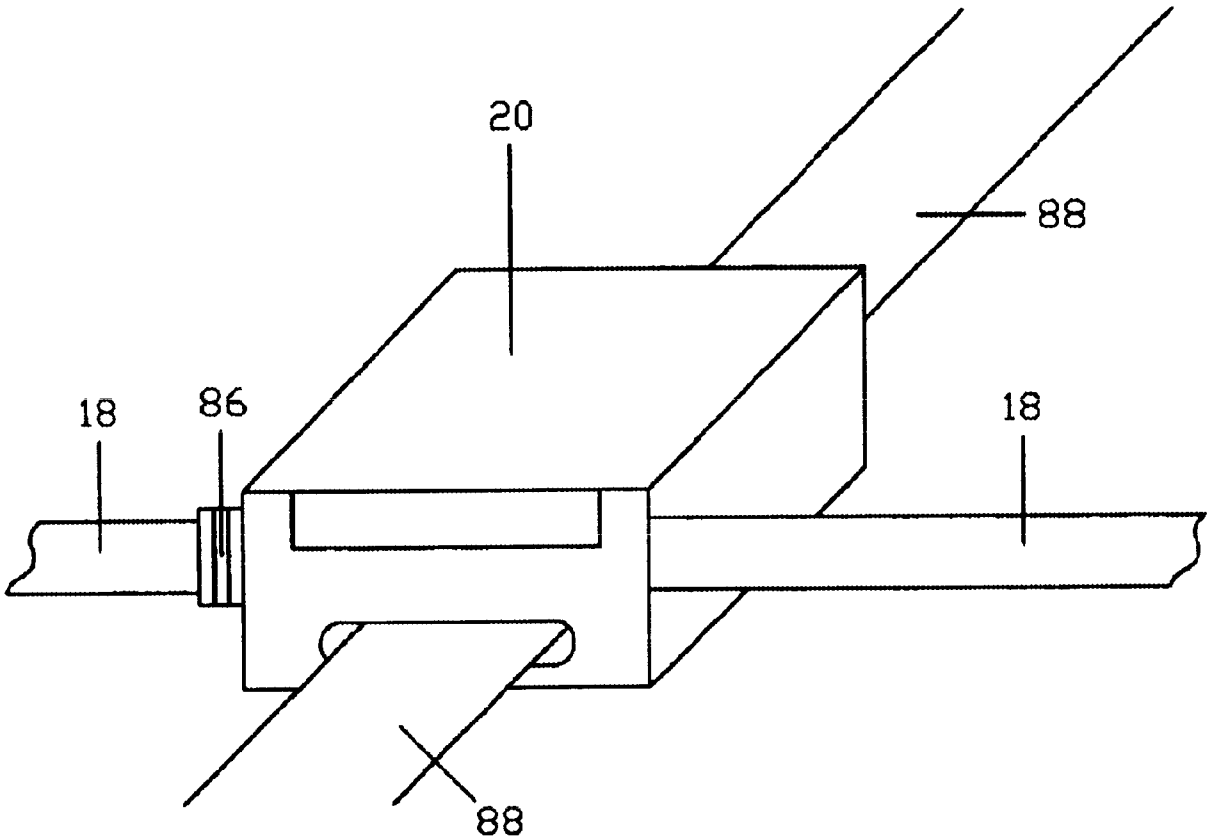
FIG. 13 is a view showing guide means for guiding the tab formed strip and the can ends through the conversion press.

As can be seen in FIG. 13, prior to entering conversion press 20, guide means 86 aligns the tab formed strip 18 for proper passes through conversion press 20, and a guide means 88 for guiding rows of can ends (not shown) through press 20 is also depicted.

Figure 14:
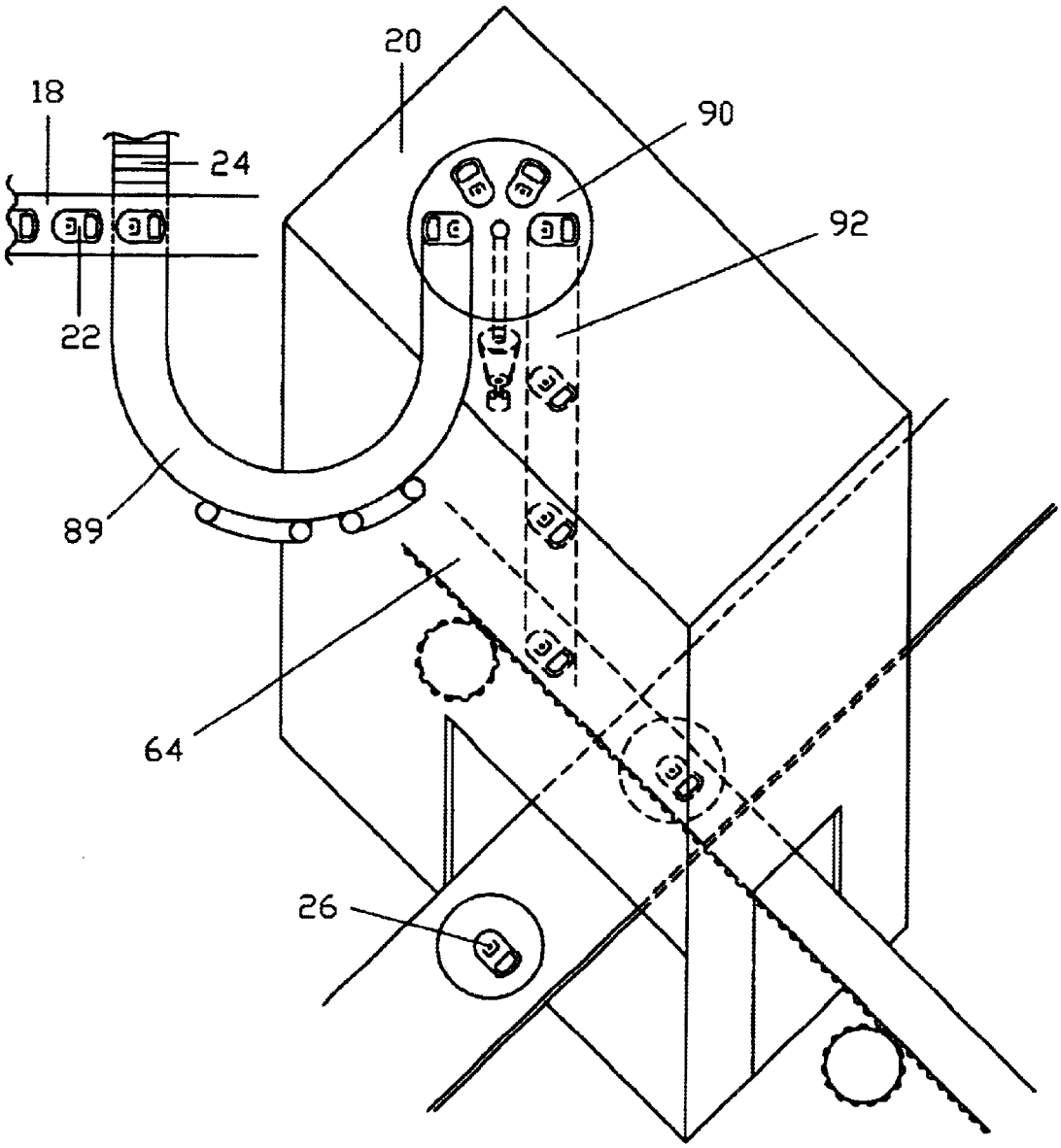
FIG. 14 is a schematic representation of a system wherein tabs are conveyed to a station at which the tabs are attached to can ends.

FIG. 14 is a schematic representation of a system wherein a strip 18 of tabs goes under a punch 24 which punches tabs 22 into a chute 89 which conveys the tabs through an inversion and to the top of a can end conversion press 20. As each tab arrives at the top of the conversion press 20, a revolving wheel 90 that contains several tab seats receives tabs 22 and rotates them around and over top of a vertical chute 92. Tabs are dropped out of the revolving wheel 90 and into chute 92 which routes the tabs to the bottom thereof to a location adjacent to a tab attachment station. A tab ejector slide 64 removes tabs from the bottom of the chute 92 and places the tabs over the can ends.

Figure 15:
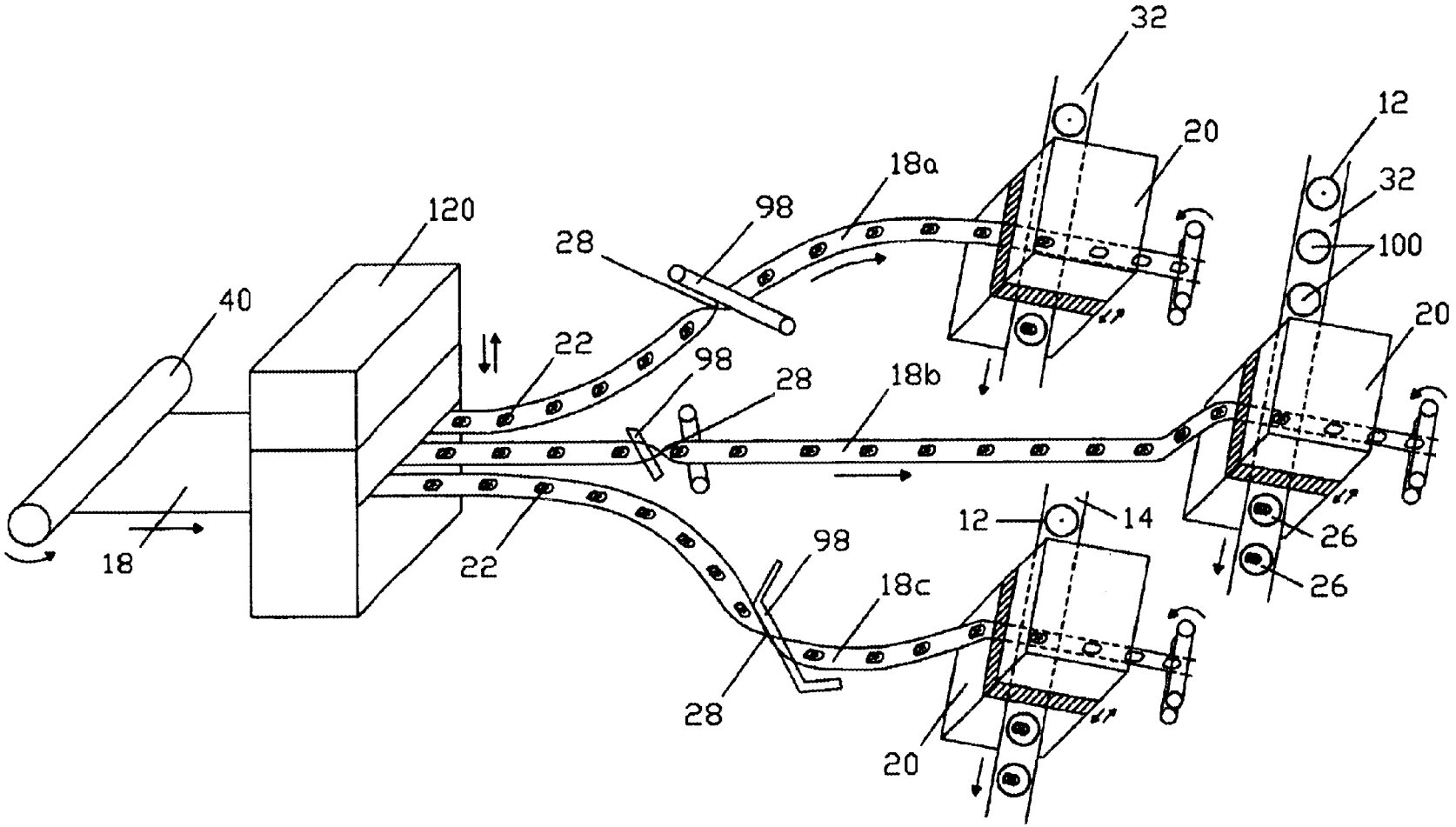
FIG. 15 is a view showing a strip of metal stock material passing through a tab press having tooling which is adapted to form a multiple lane tab formed strip and divide the strip into multiple strips, each strip containing one lane of bottom-side-up tabs. Each strip of tabs is shown to experience a half-twist as it is propelled to a designated conversion press where each tab is detached from the strip and attached to a can end.
Figure 16:
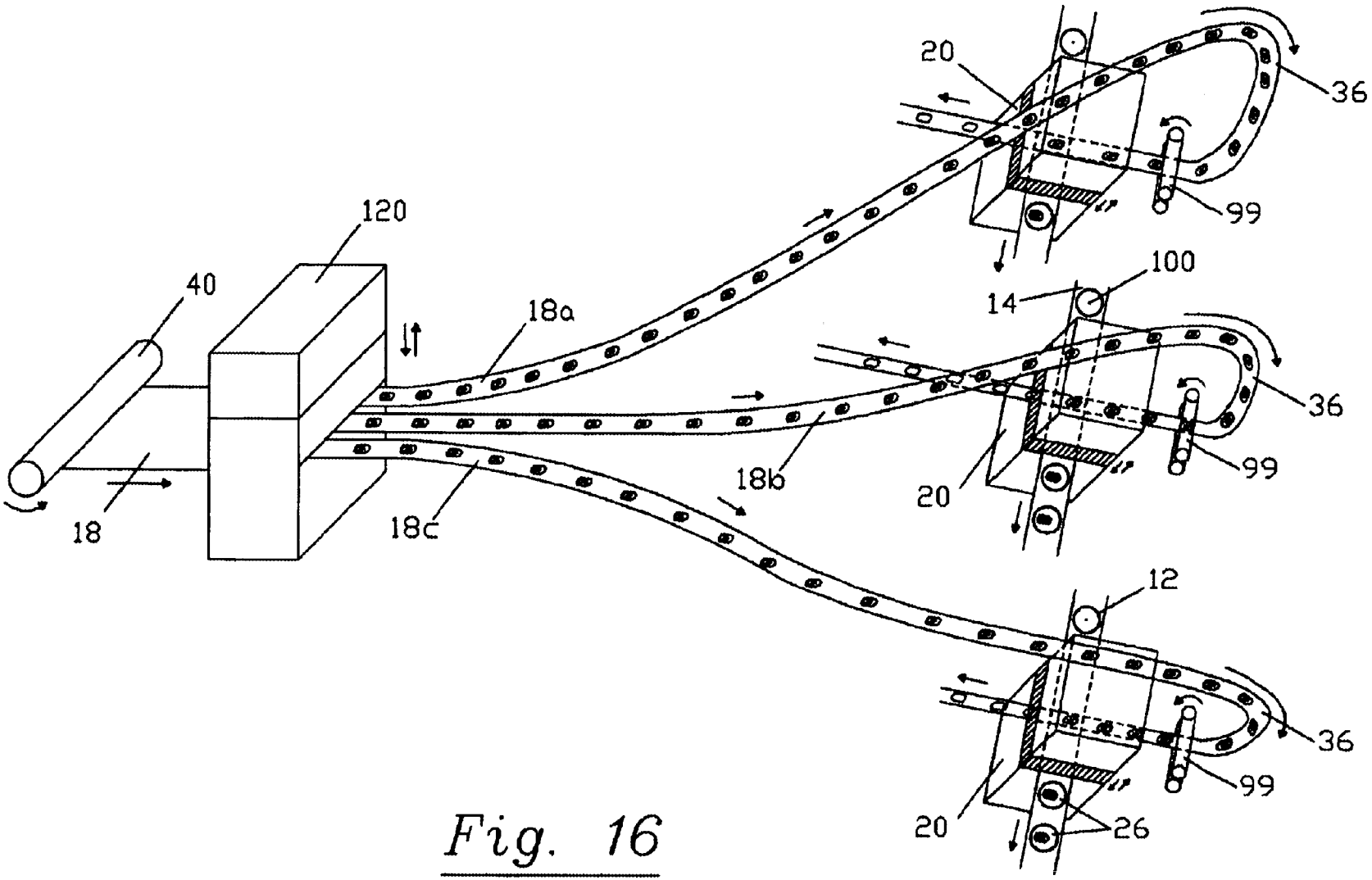
FIG. 16 is a view showing a strip of metal of metal stock material passing through a tab press having tooling which is adapted to form a multiple lane tab formed strip and divide the strip into multiple strips, each strip containing one lane of bottom-side-up tabs. Each strip of tabs is shown to experience a half-loop as it is propelled to a designated conversion press where each tab is detached from the strip and attached to a can end.

FIGS. 15 and 16 illustrate embodiments of the invention which include a tab press 120 having tooling which is adapted to form a multiple lane tab formed strip 18 and divide strip 18 into multiple strips,so that as strip 18 exits tab press 120, a plurality of strips 18*a*, 18*b*, 18*c* are created, each strip having one lane of lift-tabs 22 formed therein. The remainder of the apparatus illustrated in FIG. 15 operates in the same manner as described above in connection with FIGS. 1, 3, and 9, wherein the metal strips having lift-tabs therein pass through a half-twist 28 before entering a conversion press. FIG. 15 also shows guides 98 which have the purpose of keeping the half-twist inversion from moving along the strip 18 in such a manner that it might enter and jam the conversion presses. As long as the strip is not severed before the guide, the strip will be inverted before it passes over the guide 98 and will stay inverted so long as the proper tension on the strip is maintained.

FIG. 16 is the same as FIG. 15 except that FIG. 16 illustrates strips 18*a*, 18*b*, and 18*c* passing through half-loops 36 prior to entering conversion presses 20 rather than the half-twists as shown in FIG. 15. FIG. 16 also substitutes drive rollers 99 for the guides 98 shown in FIG. 15. Drive rollers 99 function to advance the metal strips to the conversion presses and to maintain the inversion of the strips achieved by the half-loop.

Figure 17:
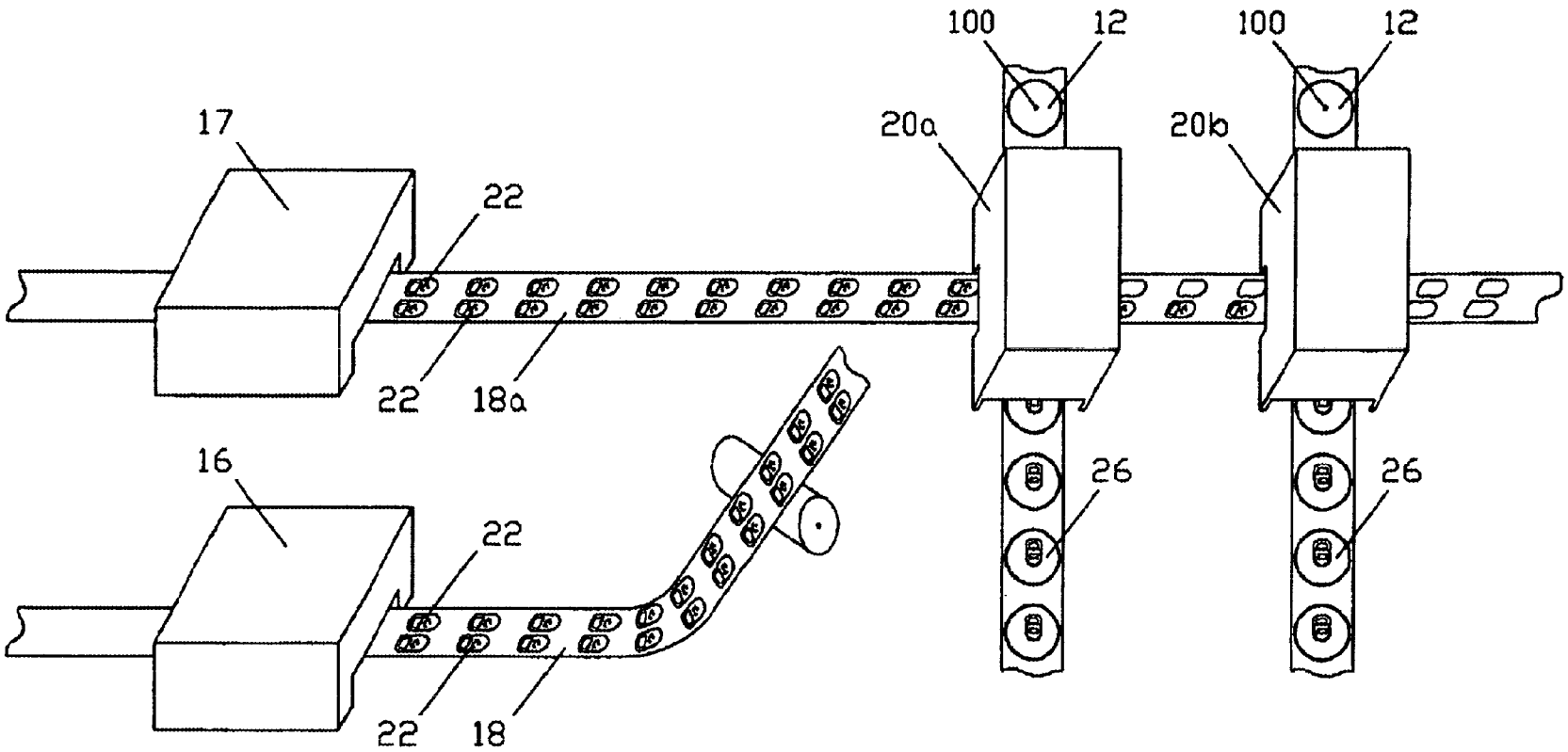
FIG. 17 is a view showing a strip of metal stock material passing through a tab press with a die which presses lift-tabs rough-side-down or smooth-side-up, The lift-tabs are pressed into the strip rough-side-down or top-side-up,and they are conveyed to a conversion press without undergoing an inversion by either half twist or half loop.

FIG. 17 illustrates an alternative embodiment of the invention in which the inversion of the lift-tabs by way of half-loop or half-twist is eliminated as unnecessary. Inversion of the lift-tabs may be eliminated by the use of tab presses 16 and 17, each of which includes a die (not shown)and each of which operates to press lift-tabs rough-side-down or smooth side up. Such die are supposedly commercially available. As shown in FIG. 17, metal strips 18 and 18*a* enter tab presses 16 and 17, where the die presses lift-tabs 22 rough-side-up or smooth-side-up. Lift-tabs 22 are then conveyed to conversion presses 20*a* and 20*b* in an orientation for proper attachment to can ends 12;consequently, inversion by way of half loop or half twist is not required. Lift-tabs 22 are connected to can ends 12 by conversion presses 20*a* and 20*b* to form lift-tab can ends 26. The apparatus illustrated in FIG. 17 may be utilized in any of the alternative routing arrangements described above.

Figure 18:
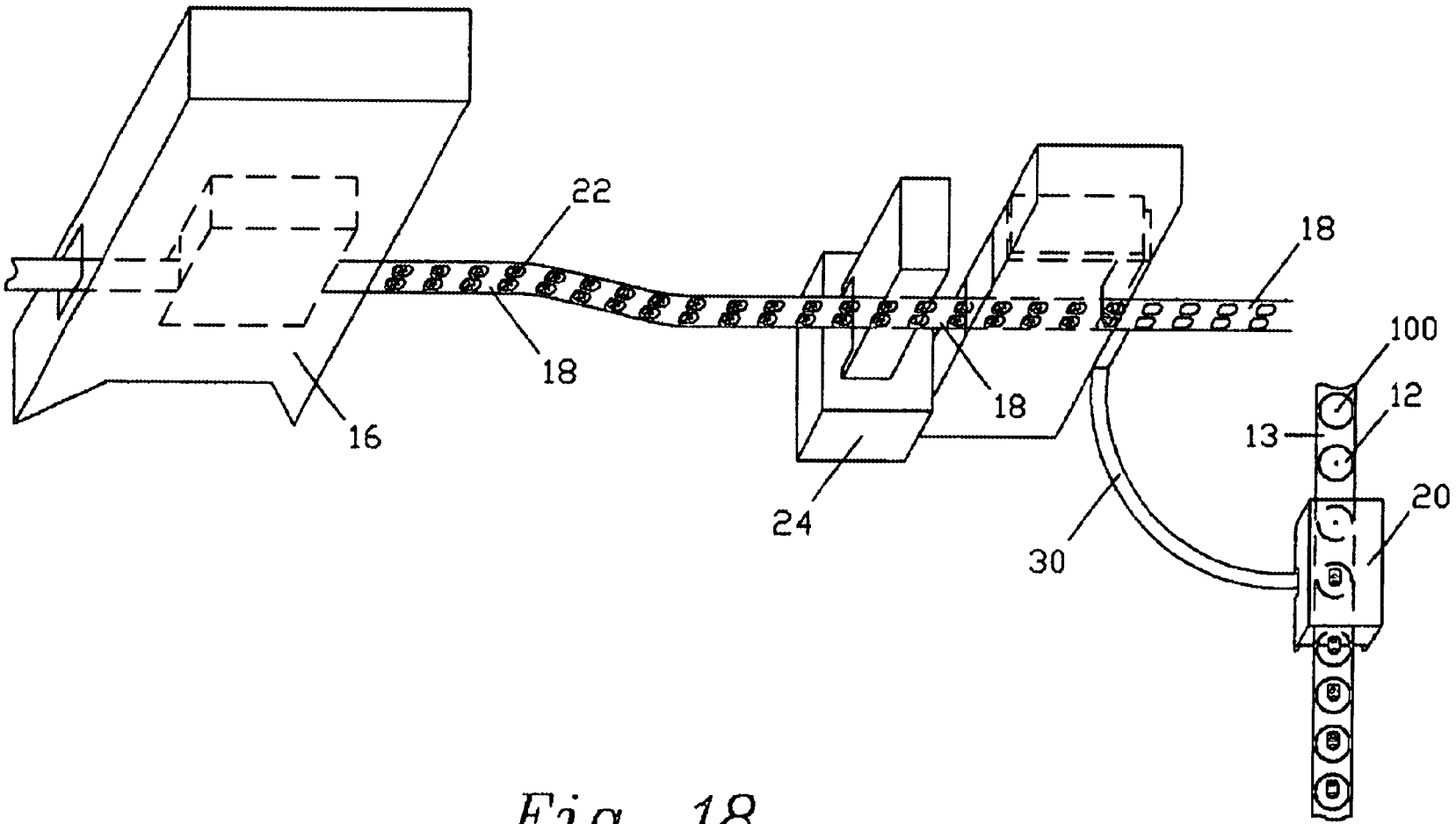
FIG. 18 is a view showing a strip of metal stock material passing through a tab press with a die which presses lift-tabs smooth-side-up. The lift-tabs are pressed into the strip top-side-up, and are conveyed to a tab punching station without undergoing an inversion. Each strip of tabs is punched into a separate conveyor of tabs by the tab punching station and thereafter each lane of tabs is conveyed to a designated conversion press where each tab is removed from the tab conveyor and attached to a can end.

FIG. 18 illustrates a schematic representation of a preferred embodiment of a system of the invention including a tab press 16, a tab punching station 24 and a conversion press 20. A strip 18 of metal stock material is passed through the tab press 16 where lift-tabs 22 are formed therein, and thereafter the strip is passed into a tab punching station 24 where tabs 22 are punched from the strip 18 into chute 30 which conveys the tabs 22 to the conversion press 20 where the tabs 22 are attached to can ends 12.

Figure 19:
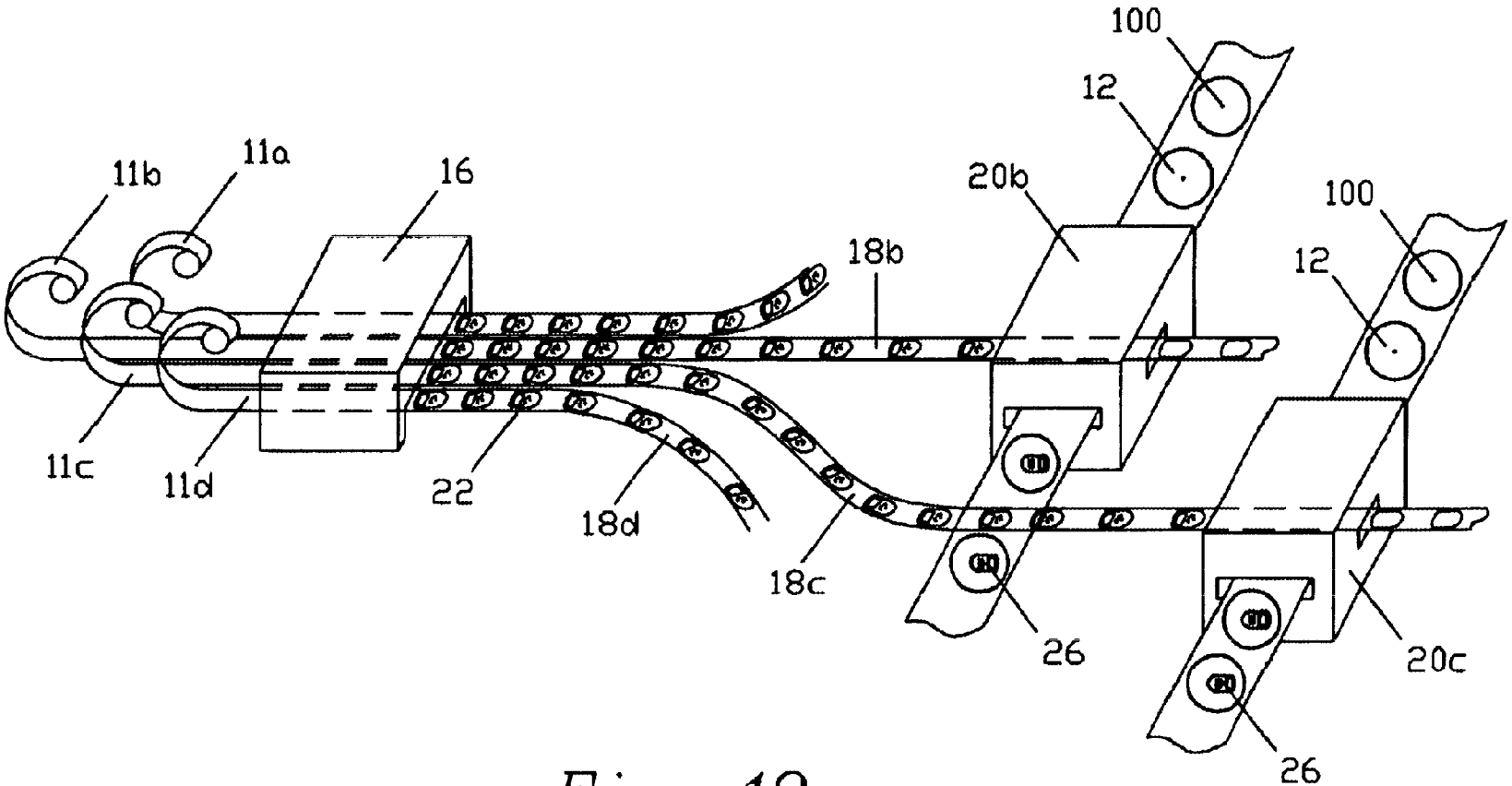
FIG. 19 is a view showing multiple strips of metal: stock material passing through a tab press having tooling which is adapted to forming multiple tab formed strips, each strip containing one lane of top-side-up tabs. Each strip of tabs is propelled to a designated conversion press where each tab is detached from the strip and attached to a can end to form a lift-tab can end.

FIG. 19 illustrates an embodiment of the tab press with strips 11*a*, 11*b*, 11*c*, 11*d* of metal stock material being routed into tab press 16 and exiting press 16 with formed tabs 22 in strips 18*b*, 18*c* before being directed into corresponding presses 20*b*, 20*c* for attachment to can ends.

Figure 20:
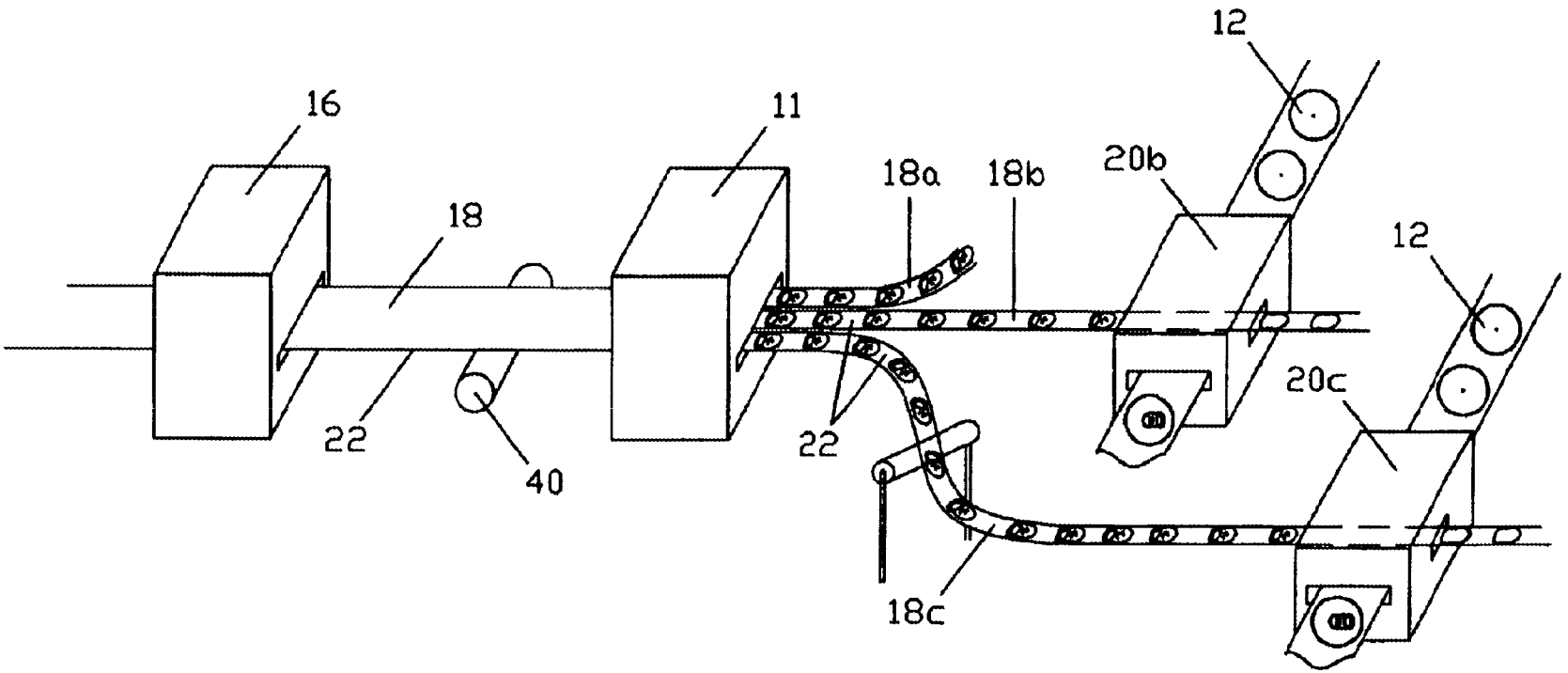
FIG. 20 is a view showing a strip of metal stock material passing through a tab press having tooling which is adapted to form a multiple lane tab formed strip and divide the strip into multiple strips, each strip containing one lane of top-side-up tabs. Each strip of tabs is propelled to a designated conversion press where each tab is detached from the strip and attached to a can end.

FIG. 20 illustrates an embodiment of the tab press with strip of metal stock material 18 being routed into tab press 11 where tabs 22 are formed in strip 18 and separated into strips 18*b*, 18*c* before being directed to corresponding end conversion presses 20*b*, 20*c* where tabs 22 are attached to can ends 12.

Although this description contains many specifics, these should not be construed as limiting the scope of the invention but as merely providing illustrations of some of the presently preferred embodiments thereof,as well as the best mode contemplated by the inventor of carrying out the invention. The invention, as described herein, is susceptible to various modifications and adaptations, and the same are intended to be comprehended within the meaning and range of equivalents of the appended claims.

What is claimed is:

1. A system for forming and attaching lift-tabs to can ends to form lift-tab can ends, said system comprising;

a tab press mounted on a frame and being adapted for forming at least one lane of lift-tabs in a strip of metal stock material;

a means for passing the strip of metal stock material with the formed lift-tabs loosely attached thereto through a tab punching station;

a drive roller supported on the frame of the tab press for moving the strip of metal stock material through the tab press;

said tab punching station having a tab punch for punching the formed tabs from the strip of metal stock material into at least one lane of formed tabs;

a conveyor means for conveying the at least, one lane of formed tabs from the tab punching station to a conversion press;

said conversion press being adapted to attach a tab onto a can end, and having a tab ejector which is adapted for feeding one tab at a time into the conversion press and a locating means for placing a tab into working relationship with a can end so that the conversion press may attach the tab onto the can end to form a lift-tab can end.

2. A system for forming and attaching lift-tabs to can ends to form lift-tab can ends, said system comprising;

a tab press, and a conversion press, each capable of independent operation;

said tab press mounted on a frame and being adapted for forming at least one lane of lift-tabs in a strip of metal stock material;

a drive roller supported on the frame of the tab press for moving the strip of metal stock material through the tab press;

a conveyor means for conveying the strip of metal stock material with the formed lift-tabs loosely attached from the tab press to a conversion press;

said conversion press being adapted to detach a tab from the strip of metal stock material and attach said tab onto a can end, and having a locating means for placing the strip of metal stock material into the conversion press with the tab being placed into working relationship with a can end so that the conversion press may detach the tab from the strip and attach the tab onto the can end to form a lift-tab can end.

3. A system for forming and attaching lift-tabs to can ends to form lift-tab can ends, said system comprising;

a tab press mounted on a frame for forming at least one lane of lift-tabs in each of a plurality of strips of metal stock material;

a drive roller supported on the frame of the tab press for moving multiple strips of metal stock material through the tab press;

conveyor means for conveying each strip of metal stock material with the formed lift-tabs loosely attached thereto from the tab press to a designated conversion press;

said conversion press being adapted to detach a tab from the strip of metal stock material and attach said tab onto a can end, and having a locating means for placing the strip of metal stock material into the conversion press with the tab being placed into working relationship with a can end so that the conversion press may detach the tab from the strip and attach the tab onto the can end to form a lift-tab can end.

4. A press assembly for forming and attaching lift-tabs to can ends to form lift-tab can ends, said press assembly comprising;

a tab press mounted on a frame for forming a plurality of lanes of lift-tabs in a strip of metal stock material, said tab press including a means for separating the strip of metal stock material into a plurality of separated strips, with each such separated strip having a lane of lift-tabs formed therein;

a drive roller supported on the frame of the tab press for moving the strip of metal stock material into the tab press;

conveyor means for conveying each strip of metal stock material with the formed lift-tabs loosely attached thereto from the tab press to a designated conversion press;

said conversion press being adapted to detach a tab from the strip of metal stock material and attach said tab onto a can end, and having a locating means for placing the strip of metal stock material into the conversion press with the tab being placed into working relationship with a can end so that the conversion press may detach the tab from the strip and attach the tab onto the can end to form a lift-tab can end.

5. A system for forming and attaching lift-tabs to can ends to form lift-tab can ends, said system comprising:

a tab press, a strip cutter, and a plurality of conversion presses, each capable of independent operation;

said tab press mounted on a frame for forming a plurality of lanes of lift-tabs in a strip of metal stock material;

a drive roller supported on the frame of the tab press for moving the strip of metal stock material through the tab press;

said strip cutter being mounted on a frame placed between the tab press and the conversion presses for separating the strip of metal stock material into a plurality of separated strips, with each such separated strip having a lane of lift-tabs formed therein;

a drive roller supported on the frame of the strip cutter for moving the strip of metal stock material having a plurality of lanes of lift-tabs formed therein through the strip cutter;

a means for inverting each of the separated strips of metal stock material with the formed lift-tabs loosely attached thereto after passing from the strip cutter and before entering a conversion press;

conveyor means for conveying each strip of metal stock material with the formed lift-tabs loosely attached thereto from the strip cutter to a designated conversion press;

said conversion press being adapted to detach a tab from the strip of metal stock material and attach said tab onto a can end, and having a locating means for placing the strip of metal stock material into the conversion press with the tab being placed into working relationship with a can end so that the conversion press may detach a tab from the strip and attach the tab onto the can end to form a lift-tab can end.

* * * * *